United States Patent [19]

Yamada et al.

[11] 4,113,488

[45] Sep. 12, 1978

[54] METHOD FOR IMPROVING THE LIGHT FASTNESS OF COLOR PHOTOGRAPHIC DYE IMAGES

[75] Inventors: Minoru Yamada; Tadao Shishido; Atsuaki Arai, all of Minami-ashigara, Japan

[73] Assignee: Fuji Photo Film Co., Ltd., Minami-ashigara, Japan

[21] Appl. No.: 686,201

[22] Filed: May 13, 1976

[30] Foreign Application Priority Data

May 13, 1975 [JP] Japan ..... 50/56973

[51] Int. Cl.[2] ..... G03C 7/00; G03C 1/40

[52] U.S. Cl. ..... 96/56; 96/74; 96/100 R

[58] Field of Search ..... 96/56, 100, 74

[56] References Cited

U.S. PATENT DOCUMENTS

| | | | |
|---|---|---|---|
| 3,057,724 | 10/1962 | Lovett et al. | 96/100 |
| 3,597,207 | 8/1971 | Kuh et al. | 96/56 |
| 3,801,322 | 4/1974 | Shirasu et al. | 96/56 |
| 3,935,016 | 1/1976 | Nishimura et al. | 96/56 |
| 3,982,944 | 9/1976 | Ohi et al. | 96/56 |

*Primary Examiner*—J. Travis Brown

*Attorney, Agent, or Firm*—Sughrue, Rothwell, Mion, Zinn and Macpeak

[57] ABSTRACT

A method for improving the light fastness of a magenta color image in a silver halide color photograph which comprises incorporating into a layer containing a magenta color image, which is formed upon reaction of a magenta coupler and an oxidation product of an aromatic primary amine color developing agent, at least one light fastness improving phenolic compound and at least one synergistic light fastness improving agent selected from a sulfide or sulfoxide compound represented by the following general formula (V):

X—B—Y (V)

wherein B represents —S— or —SO—; X and Y, which may be the same or different, each represents $-(CH_2)_n-R_1$, or and $R_1$ represents $-COOR_3$, $-OR_6$, $-O-COR_6$, $-NHSO_2R_6$, $-NHCOR_6$, a cyano group, an aryl group or a hydroxy group; $R_2$ represents an alkyl group of 1 to 30 carbon atoms, an aryl group, an aralkyl group, a hydroxy group, a cyano group or $-COOR_3$; $R_3$, $R_4$, $R_5$ and $R_6$ each represents a hydrogen atom, an alkyl group of 1 to 30 carbon atoms, an aryl group, or an aralkyl group, with the proviso that $R_6$ is not a hydrogen atom; and $n$ is an integer of 1 to 4. A silver halide color photographic light-sensitive material which provides a magenta dye image having a good light fastness is also disclosed.

24 Claims, No Drawings

METHOD FOR IMPROVING THE LIGHT FASTNESS OF COLOR PHOTOGRAPHIC DYE IMAGES

BACKGROUND OF THE INVENTION

1. Field of the Invention

The present invention relates to a silver halide color photographic light-sensitive material, more particularly, to a silver halide color photographic light-sensitive material which provides a stable magenta color image inhibited from light fading when it is subjected to light exposure for a long period of time.

2. Description of the Prior Art

It is known that by the color development of a silver halide color photographic material an oxidized aromatic primary amine color developing agent is reacted with a coupler to form a dye, such as an indophenol, an indoaniline, an indamine, an azomethine, a phenoxazine, a phenazine and the like, thus forming a color image. In this method, a subtractive color process is ordinarily used for color reproduction wherein blue, green and red sensitive silver halide emulsions and complementary color (i.e., yellow, magenta and cyan, respectively) forming couplers are associated with each other. For example, a coupler of the acylacetanilide or dibenzoylmethane type is used for forming a yellow color image, a coupler of the pyrazolone, pyrazolobenzimidazole, cyanoacetophenone or indazolone type is used for forming a magenta color image and a coupler of the phenolic type, such as a phenol and a naphthol, is used for forming a cyan color image.

Color images tend to fade upon exposure to light for long periods of time. In particular, the fading of magenta color images by light is a serious problem with maintaining a color photograph stable without changes during storage for long periods of time.

Several attempts have been made to improve the light fastness of magenta color images which are formed from 5-pyrazolone couplers. For instance, they include a method in which an ultraviolet absorbing agent capable of protecting the color image from the action of ultraviolet rays is incorporated in a color photographic material, a method in which the structure of the coupler is appropriately modified so as to provide a dye which is stable to light per se, a method using a light fastness improving agent which inhibits the decomposition of the dye caused by light, and the like. Many means for improving the light fastness of magenta color images are known, some of which are described in the following.

(I) The incorporation of an alkyl hydroquinone into a photographic layer is described in U.S. Pat. Nos. 2,336,327, 2,360,290, 2,403,721, 2,418,613, 2,704,713, 2,728,659, 2,732,300 and 2,735,765. Some of these compounds are described as being effective for stabilizing a color image.

(II) The use of an $\alpha$-tocopherol is described in U.S. Pat. No. 2,360,290.

(III) The use of a 6-hydroxychroman derivative as a light fastness improving agent is described in U.S. Pat. No. 3,432,300.

(IV) The use of a 5-hydroxycoumaran derivative as a light fastness improving agent is described in U.S. Pat. No. 3,573,050.

(V) The use of a hexahydrodibenzofuran-5-ol tricyclic compound as a light fastness improving agent is described in U.S. Pat. No. 3,574,627.

(VI) The use of a 6,6'-dihydroxy-4,4,4',4'-tetramethyl-bis-2,2'-spirochroman derivative as a light fastness improving agent is described in U.S. Pat. No. 3,764,337.

(VII) A method for improving light fastness using a sterically hindered phenol as a coupler solvent is described in U.S. Pat. No. 3,698,909.

(VIII) The use of an alkoxy phenol as a light fastness improving agent is described in German patent application (OLS) No. 2,146,668.

(IX) A method for improving the light fastness of color images formed using a 5-pyrazolone coupler in which a 6-hydroxychroman or a 4-substituted phenol derivative is bonded to a coupler skeleton as a light fastness improving group is described in U.S. Pat. No. 3,519,429.

(X) A method for improving the light fastness of color images using a coupler in which a 2-(2'-hydroxyphenyl)benzotriazole derivative is bonded to a coupler skeleton is described in German patent application (OLS) No. 2,216,578.

(XI) The use of a phenol derivative, a bisphenol derivative or a polyphenol derivative as a light fastness improving agent is described in Japanese patent publications Nos. 31625/1973, 31626/1973, and 31256/1973 (U.S. Pat. No. 3,700,455), Japanese patent applications (OPI) Nos. 26133/1973, 6338/1975, 6339/1975, and 134326/1974 and U.S. Pat. No. 2,735,765.

(XII) A method for improving the light fastness of color images using an ultraviolet absorbing agent in combination with a phenol derivative is described in Japanese patent publication No. 26138/1974 and Japanese patent application (OPI) No. 23822/1975.

(XIII) The use of a hydantoin derivative and a piperidine derivative as light fastness improving agents is described in German patent applications (OLS) Nos. 2,126,187 (Japanese patent publication No. 20973/1974) and 2,126,954 (Japanese patent publication No. 20974/1974 and Japanese patent application (OPI) No. 37635/1972).

(XIV) A method for improving the light fastness of color images in addition to decreasing stain (mainly yellow stain) in non-image areas and improving the stability of a coupler using a 3-anilino type magenta coupler in combination with a phenolic compound having an ether bond at the 4-position and a nucleus-substituted hydroquinone compound is described in German patent application (OLS) No. 2,420,066 (Japanese patent application (OPI) No. 134327/1974).

Of these methods for improving the light fastness of color images, those described in (I), (II), (VIII), (X), (XI), (XII) and (XIII) provide insufficient results with respect to the light fastness of magenta color images. On the other hand, by the methods described in (III), (IV), (V), (VI), (VII), (IX) and (XIV), the light fastness of magenta color images is improved in comparison with the other prior art methods, but light fastness is still insufficient.

Of a yellow color image, a cyan color image and a magenta color image, the former two have good light fastness which has been achieved by research over a long period of time. On the contrary, the light fastness of magenta color images is still insufficient, and, thus, it has been desired in the art to further increase the light fastness of magenta color images so as to obtain a balance of the light fastness of the three colors. However, it has been considered by the art that a further improvement of the light fastness of magenta color images is extremely difficult and could not be attained. The present invention provides such a further improvement.

SUMMARY OF THE INVENTION

One object of the present invention is to provide a method for improving the light fastness of a magenta color image of a color photograph and a color photographic light-sensitive material having such improved light fastness.

Another object of the present invention is to provide a color photograph after processing which has a clear color image and a lesser extent of yellow stain in non-image areas.

Still another object of the present invention is to provide a simple and economical method for stabilizing a color image.

A further object of the present invention is to provide a color photograph in which the degrees of light fastness of three color images are balanced.

A still further object of the present invention is to provide a color photograph having a color image of improved light fastness which shows no adverse affect on the stability of a coupler or the photographic properties thereof.

Other objects of the present invention will be apparent from the following detailed description and examples.

These objects of the present invention are reached by the use of a silver halide color photographic material having exceptionally improved light fastness of magenta color images or by a method for exceptionally improving the light fastness of magenta color images which comprises incorporating a light fastness improving phenolic agent or a sulfide or a sulfoxide compound represented by General Formula (V) which promotes the inhibition of light fading (synergistic light fastness improving agent) into at least one silver halide emulsion layer containing a magenta coupler which forms a non-diffusible magenta color image upon oxidative coupling with an aromatic primary amine developing agent or into an image receiving layer which receives a diffusible dye formed from a non-diffusible magenta coupler to form a magenta color image on a support of a photographic material.

Further, these objects are accomplished with a silver halide color photographic material having exceptionally improved light fastness of magenta color images or a method for exceptionally improving the light fastness of magenta color images which comprises incorporating a light fastness improving phenolic agent, a sulfide or a sulfoxide compound represented by General Formula (V) which promotes the inhibition of light fading and a nucleus substituted hydroquinone into such a layer with a magenta color image. In the latter case, an inhibiting effect on the formation of yellow stains in non-image areas of a processed color photograph is particularly observed in addition to the exceptionally improved light fastness of a magenta color image.

DETAILED DESCRIPTION OF THE INVENTION

According to the present invention, the effect for improving the light fastness of magenta color images is obtained which could not be expected from the use of the sulfide or sulfoxide compound promoting the inhibition of light fading alone. Although such an effect is known in the antioxidant field as a synergistic effect, it is an extremely useful and surprising fact that such a synergistic effect was found in the field of improving the light fastness of a magenta color image in a color photographic light-sensitive material.

Of the phenolic compounds and the sulfide or sulfoxide compounds used in the present invention, compounds which are known as degradation preventing agents for synthetic rubbers, synthetic resins or petroleum products are included. However, although a great number of compounds can be used as degradation preventing agents for such chemical products, compounds which can be practically used for effectively preventing light fading in a color photographic light-sensitive material are extremely restricted. The use of the synergistic light fastness improving agents which provide the synergistic light fastness effect without any deteriorating influence on the photographic properties of a color photographic material (which requires unusually delicate techniques) in combination with the light fastness improving agents according to the present invention is extremely valuable.

The magenta couplers which can be used in the present invention can be selected from a wide range of conventional magenta couplers. Magenta couplers providing particularly advantageous effects are represented by the following General Formulae (I) and (II).

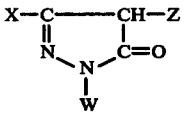
(I)

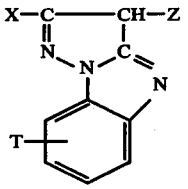
(II)

Wherein W represents a hydrogen atom or a group with 1 to 35 carbon atoms, preferably 1 to 22 carbon atoms which includes a straight chain or branched chain alkyl group (for example, a methyl, isopropyl, tert-butyl, hexyl, dodecyl group, etc.), an alkenyl group (for example, an allyl group, etc.), a cycloalkyl group (for example, a cyclopentyl, cyclohexyl, norbornyl group, etc.), an aralkyl group (for example, a benzyl, β-phenylethyl group, etc.) and a cycloalkenyl group (for example, a cyclopentenyl, cyclohexenyl group, etc.); which groups can be substituted with a substituent selected from a halogen atom or a nitro, cyano, (in the following, the abbreviation "C" followed by a numerical range indicates the preferred number of carbon atoms in the preceeding moiety), monoaryl (C: 6–12), alkoxy C: 1–20), monoaryloxy (C: 6–12), carboxy, alkylcarbonyl (where the alkyl moiety preferably has 1 to 20 carbon atoms), monoarylcarbonyl (where the aryl moiety preferably has 6 to 12 carbon atoms), alkoxycarbonyl (where the alkoxy moiety preferably has 1 to 20 carbon atoms), monoaryloxycarbonyl (where the aryloxy moiety preferably has 6 to 12 carbon atoms), sulfo, acyloxy (C: 2 to 20), sulfamoyl, carbamoyl, acylamino (C: 2 to 20), imido having 3 to 20 carbon atoms (for example, succinimido, maleimido, phthalimido, glutarimido, heptadecanoylaminosuccinimido, adipic acid imido and 3-(2,4-di-t-pentylphenyloxyacetamido)-phthalimido, etc.), ureido, thioureido, urethane, thiourethane, sulfonamido, heterocyclic (preferably a 5-membered or 6-membered heterocyclic group which can be condensed with an aromatic ring such as benzene, etc., for example, N-pyrrolidinyl and N-morpholino, etc.), arylsulfonyloxy (where the aryl moiety preferably has 6 to 12 carbon atoms and can comprise a single or condensed ring), alkylsulfonyloxy (C: 1 to 20), arylsulfonyl (where the aryl moiety preferably has 6 to 12 carbon atoms and can comprise a single or condensed ring), alkylsulfonyl (C: 1 to 20), arylthio (where the aryl moiety preferably has 6 to 12 carbon atoms and can comprise a single or condensed ring), alkylthio (C: 1 to 20), alkylsulfinyl (C: 1 to 20), arylsulfinyl (where the aryl moiety preferably has 6 to 12 carbon atoms and can comprise a single or condensed ring), alkylamino (C: 1 to 20), dialkylamino (C: 2 to 24), anilino, N-arylanilino (where the aryl moiety preferably has 6 to 12 carbon atoms and can comprise a single or condensed ring), N-alkylanilino (where the alkyl moiety preferably has 1 to 20 carbon atoms), N-acylanilino (where the acyl moiety preferably has 2 to 20 carbon atoms), hydroxy and mercapto group;

or W represents an aryl group (preferably an aryl group having 6 to 12 carbon atoms and comprises a single or condensed ring, for example, a phenyl, α- or β-naphthyl group, etc.) and an aryl group having 1 to 5 substituents. Such substituents are selected from a halogen atom or an alkyl (C: 1 to 20), alkenyl (C: 1 to 20), monocycloalkyl (C: 5 to 7), aralkyl (C: 7 to 10, where the aryl moiety preferably has a single ring), monocycloalkenyl (C: 5 to 7), nitro, cyano, mono- or poly-aryl (C: 6 to 12), alkoxy (C: 1 to 20), mono- or poly-aryloxy (C: 6 to 12), carboxy, alkylcarbonyl (where the alkyl moiety preferably has 1 to 20 carbon atoms), arylcarbonyl (where the aryl moiety preferably has 6 to 12 carbon atoms and comprises a single or condensed ring), alkoxycarbonyl (where the alkoxy moiety preferably has 1 to 20 carbon atoms), aryloxycarbonyl (where the aryl moiety preferably has 6 to 12 carbon atoms and comprises a single or condensed ring), sulfo, acyloxy (C: 2 to 20), sulfamoyl, carbamoyl, acylamino (C: 2 to 20), imido (C: 3 to 20), ureido, thioureido, urethane, thiourethane, sulfonamido, heterocyclic (for example, a 5-membered or 6-membered heterocyclic group which can be condensed with an aromatic ring such as benzene, etc., and containing N, O and/or S as a hetero atom, for example, pyrrolidinyl, piperidyl, morpholino, pyridyl, quinolyl, furyl, benzothiazolyl, oxazolyl and imidazolyl, etc.), arylsulfonyloxy (where the aryl moiety preferably has 6 to 12 carbon atoms and comprises a single or condensed ring), alkylsulfonyloxy (C: 1 to 20), arylsulfonyl (where the aryl moiety preferably has 6 to 12 carbon atoms and comprises a single or condensed ring), alkylsulfonyl (C: 1 to 20), arylthio (where the aryl moiety preferably has 6 to 12 carbon atoms and comprises a single or condensed ring), alkylthio (C: 1 to 20), alkylsulfinyl (C: 1 to 20), arylsulfinyl (where the aryl moiety preferably has 6 to 12 carbon atoms and comprises a single or condensed ring), alkylamino (C: 1 to 20), dialkylamino (C: 2 to 24), anilino, N-alkylanilino (where the alkyl moiety preferably has 1 to 20 carbon atoms), N-arylanilino (where the aryl moiety preferably has 6 to 12 carbon atoms and comprises a single or condensed ring), N-acylanilino (where the acyl moiety preferably has 2 to 20 carbon atoms), hydroxy and mercapto group. A phenyl group in which at least one of the ortho-position is substituted with an alkyl group preferably having 1 to 8 carbon atoms, an alkoxy group preferably having 1 to 8 carbon atoms or a halogen atom is particularly useful for W, since when the coupler remains in a color photographic material after development, less printout by the action of light or heat occur.

Furthermore, W represents a heterocyclic group (for example, a 5-membered or 6-membered heterocyclic group or a condensed heterocyclic group, for example, condensed with a benzene ring or a naphthylene ring, containing a nitrogen atom, an oxygen atom or a sulfur atom as a hetero atom (for ease of production, the balance of the atoms being a carbon atoms) such as a pyridyl, quinolyl, furyl, benzothiazolyl, oxazolyl, imidazolyl, naphthoxazolyl group, etc.) or a substituted heterocyclic group with the one or more substituents above described for the aryl group.

Furthermore, W represents an acyl group (C: 2 to 20), thioacyl group (C: 2 to 20), alkylsulfonyl group (C: 1 to 20), arylsulfonyl group (C: 6 to 12, comprising a single or condensed ring), alkylsulfinyl group (C: 1 to 20), arylsulfinyl group (C: 6 to 12, comprising a single or condensed ring), carbamoyl group or thiocarbamoyl group.

In the formulae, X represents a hydrogen atom or a group having 1 to 35 carbon atoms, preferably 1 to 22 carbon atoms which includes a straight chain or branched chain alkyl group, an alkenyl group, a cycloalkyl group, an aralkyl group and a cycloalkenyl group, which groups can have the one or more substituents above described for W;

Further, X represents an aryl group preferably having 6 to 12 carbon atoms, and comprises a single or condensed ring, or a heterocyclic group which can be substituted with the one or more substituents as described for W, where the heterocyclic group preferably is a 5-membered or 6-membered heterocyclic group or a condensed heterocyclic group containing a nitrogen atom, an oxygen atom or a sulfur atom as a hetero atom;

Furthermore, X represents an alkoxycarbonyl group (wherein the alkoxy moiety preferably has 1 to 20 carbon atoms, for example, a methoxycarbonyl, ethoxycarbonyl, stearyloxycarbonyl group, etc.), an aryloxycarbonyl group (wherein the aryl moiety preferably has 6 to 12 carbon atoms and comprises a single or condensed ring, for example, a phenoxycarbonyl, α- or β-naphthoxycarbonyl group, etc.), an aralkyloxycarbonyl group (wherein the aralkyloxy moiety preferably has 7 to 10 carbon atoms and the aryl moiety comprises a single or condensed ring, for example, a benzyloxycarbonyl group, etc.), an alkoxy group (preferably having 1 to 20 carbon atoms, for example, a methoxy, ethoxy, dodecyloxy group, etc.), an aryloxy group (wherein the aryl moiety preferably has 6 to 12 carbon atoms and comprises a single or condensed ring, for example, a phenoxy, tolyloxy group, etc.), an alkylthio group (preferably having 1 to 20 carbon atoms, for example, an ethylthio, dodecylthio group, etc.), an arylthio group (wherein the aryl moiety preferably has 6 to 12 carbon atoms and comprises a single or condensed ring, for example, a phenylthio, α-naphthylthio group, etc.), a carboxy group, an acylamino group (preferably having 2 to 20 carbon atoms, for example, an acetylamido, 3-[(2,4-di-tert-amylphenoxy)acetamido]-benzamido group, etc.), an imido group, preferably having 3 to 20 carbon atoms, an N-alkylacylamino group (wherein the alkyl moiety preferably has 1 to 20 carbon atoms, for example, an N-methylpropionamido group, etc.), an N-arylacylamino group (wherein the aryl moiety preferably has 6 to 12 carbon atoms and comprises a single or condensed ring, for example, an N-phenylacetamido group, etc.), a ureido group (for example, a ureido, N-arylureido (wherein the aryl moiety preferably has 6 to 12 carbon atoms and comprises a single or condensed ring), or N-alkylureido group (where the alkyl moiety preferably has 1 to 20 carbon atoms), etc.), a thioureido group (for example, a thioureido, N-arylthioureido (where the aryl moiety preferably has 6 to 12 carbon atoms and comprises a single or condensed ring), or N-alkylthioureido group (where the alkyl moiety preferably has 1 to 20 carbon atoms) etc.), a urethane group, a thiourethane group, an anilino group (for example, a phenylamino, N-alkylanilino (where the alkyl moiety preferably has 1 to 20 carbon atoms) N-arylanilino (where the aryl moiety preferably has 6 to 12 carbon atoms and comprises a single or condensed ring), N-acylanilino (where the acyl moiety preferably has 2 to 20 carbon atoms,) or 2-chloro-5-tetradecanamidoanilino group, etc.), an alkylamino group (preferably having 1 to 20 carbon atoms, for example, an N-butylamino, N,N-dialkylamino or cycloalkyl amino group (where the cycloalkyl moiety preferably has 5 to 7 carbon atoms and comprises a single ring, etc.)), a cycloamino group (preferably having 4 to 9 carbon atoms and comprises a single or condensed ring, for example, a piperidino, pyrrolidino group, etc.), an alkylcarbonyl group (wherein the alkyl moiety preferably has 1 to 20 carbon atoms, for example, a methylcarbonyl group, etc.), an arylcarbonyl group (wherein the aryl moiety preferably has 6 to 12 carbon atoms and comprises a single or condensed ring, for example, a phenylcarbonyl group, etc.), a sulfonamido group (for example, an alkylsulfonamido (where the alkyl moiety preferably has 1 to 20 carbon atoms) or arylsulfonamido group where the aryl moiety preferably has 6 to 12 carbon atoms and comprises a single or condensed ring, etc.), a carbamoyl group (for example, an N-alkylcarbamoyl (where the alkyl moiety preferably has 1 to 20 carbon atoms), N,N-dialkylcarbamoyl (where the alkyl moiety preferably has 1 to 20 carbon atoms) N-alkyl-N-arylcarbamoyl (where the alkyl moiety preferably has 1 to 20 carbon atoms, and the aryl moiety preferably has 6 to 12 carbon atoms and comprises a single or condensed ring), N-arylcarbamoyl (where the aryl moiety preferably has 6 to 12 carbon atoms and comprises a single or condensed ring), or N,N-diarylcarbamoyl group where the aryl moiety preferably has 6 to 12 carbon atoms and comprises a single or condensed ring, etc.), a sulfamoyl group (for example, an N-alkylsulfamoyl (where the alkyl moiety preferably has 1 to 20 carbon atoms), N,N-dialkylsulfamoyl (where the alkyl moiety preferably has 1 to 24 carbon atoms), N-arylsulfamoyl (where the aryl moiety preferably has 6 to 12 carbon atoms and comprises a single or condensed ring N-alkyl-N-arylsulfamoyl (where the alkyl moiety preferably has 1 to 20 carbon atoms, and the aryl moiety preferably has 6 to 12 carbon atoms and comprises a single or condensed ring) or N,N-diarylsulfamoyl group (where the aryl moiety preferably has 6 to 12 carbon atoms and comprises a single or condensed ring), etc.), a guanidino group (for example, an N-alkyl guanidino (where the alkyl moiety preferably has 1 to 20 carbon atoms) or N-arylguanidino group (where the aryl moiety preferably has 6 to 12 carbon atoms and comprises a single or condensed ring), etc.), a cyano group, an acyloxy group (for example, a tetradecanoyloxy group, etc.), a sulfonyloxy group (for example, an alkylsulfonyl (preferably having 1 to 20 carbon atoms), arylsulfonyl (preferably having 6 to 12 carbon atoms and comprises a single or condensed ring) or an aralkylsulfonyl group (preferably having 7 to 12 carbon atoms), for example, benzenesulfonyloxy, dodecylsulfonyloxy group, etc.,); a hydroxy group, mercapto group, a halogen atom or a sulfo group;

T represents a hydrogen atom or a group having 1 to 35 carbon atoms, preferably 1 to 22 carbon atoms, which includes a straight chain or branched chain alkyl group, an alkenyl group, a cycloalkyl group, an aralkyl group, and a cycloalkenyl group which can be substituted with the one or more substituents as described for W;

Further, T represents an aryl group, preferably having 6 to 12 carbon atoms and comprises a single or condensed ring, or a heterocyclic group which can be substituted with one or more substituents as described for W, where the heterocyclic group preferably is a 5-membered or 6-membered heterocyclic group or a condensed heterocyclic group containing a nitrogen atom, an oxygen atom or a sulfur atom as a hetero atom.

Or T can represent a halogen atom, a cyano group, an alkoxy group (preferably having 1 to 20 carbon atoms), an aryloxy group (preferably having 6 to 12 carbon atoms and comprises a single or condensed ring), a carboxy group, an alkoxycarbonyl group (preferably having an alkoxy moiety with 1 to 20 carbon atoms), an aryloxycarbonyl group (preferably having an aryl moiety with 6 to 12 carbon atoms and comprises a single or condensed ring), an acyloxy group (preferably having 2 to 20 carbon atoms), an alkylcarbonyl group (preferably having an alkyl moiety with 1 to 20 carbon atoms), an arylcarbonyl group (preferably having an aryl moiety with 6 to 12 carbon atoms and comprises a single or condensed ring), an alkylthiocarbonyl group (preferably having an alkyl moiety with 1 to 20 carbon atoms), a sulfo group, a sulfamoyl group, a carbamoyl group, an arylthiocarbonyl group (preferably having an aryl moiety with 6 to 12 carbon atoms and comprises a single or condensed ring), an acylamino group (preferably having 2 to 20 carbon atoms), an imido group (preferably having 3 to 20 carbon atoms), a ureido group, a thioureido group, a urethane group, a thiourethane group, a sulfonamido group, an alkylsulfonyloxy group (preferably having 1 to 20 carbon atoms), an arylsulfonyloxy group (preferably having an aryl moiety with 6 to 12 carbon atoms and comprises a single or condensed ring), an arylsulfonyl group (preferably having an aryl moiety with 6 to 12 carbon atoms and comprises a single or condensed ring), an alkylsulfonyl group (preferably having 1 to 20 carbon atoms) an arylthio group (preferably having an aryl moiety with 6 to 12 carbon atoms and comprises a single or condensed ring), an alkylthio group (preferably having 1 to 20 carbon atoms), an alkylsulfinyl group (preferably having 1 to 20 carbon atoms), an arylsulfinyl group (preferably having an aryl moiety with 6 to 12 carbon atoms and comprises a single or condensed ring), an alkylamino group (preferably having 1 to 20 carbon atoms), a dialkylamino group (preferably having 2 to 24 carbon atoms), an anilino group, an N-arylanilino group (preferably having an aryl moiety with 6 to 12 carbon atoms and comprises a single or condensed ring), an N-alkylanilino group (preferably having an alkyl moiety with 1 to 20 carbon atoms), an N-acylanilino group (preferably having an acyl moiety with 2 to 20 carbon atoms), a hydroxy group or a mercapto group.

Z preferably represents a hydrogen atom or a coupling-off group bonded to the coupling position through an oxygen atom, a nitrogen atom or a sulfur atom.

Z more preferably represents a hydrogen atom or a coupling off group in which an alkyl group preferably having 1 to 20 carbon atoms, which includes a straight chain or branched chain alkyl group, an aryl group preferably having 6 to 12 carbon atoms and comprises a single or condensed ring, a sulfonyl group, a sulfinyl group, a carbonyl group, a phosphoric acid group a thiocarbonyl group, or a heterocyclic group (where the heterocyclic group preferably is a 5-membered or 6-membered heterocyclic group or a condensed heterocyclic group containing a nitrogen atom, an oxygen atom or a sulfur atom as a hetero atom) is bonded to an oxygen atom, a nitrogen atom or a sulfur atom which is directly bonded to the coupling position or a coupling-off group forming a 5- or 6-membered nitrogen containing ring (the maximum number of nitrogen atoms being 4) in which the nitrogen atom is directly bonded to the coupling position, and the heterocyclic ring preferably having 1 to 14 carbon atoms, for example, tetrazolyl, benztriazole-1-yl, benztriazole-2-yl, 1-benzimidazolyl, pyrrolidinyl, piperidyl, morpholinyl, etc.

Preferred coupling off groups for Z which are bonded to the coupling position through an oxygen atom include, for example, an acyloxy group preferably having 2 to 20 carbon atoms, an aryloxy group preferably having 6 to 12 carbon atoms and comprises a single or condensed ring, an alkoxy group preferably having 1 to 20 carbon atoms, an alkoxycarbonyloxy group wherein the alkoxy moiety preferably has 1 to 20 carbon atoms, an alkoxalyl group wherein the alkoxy moiety preferably has 1 to 20 carbon atoms, a heterocyclic oxy group, preferably having a 5- or 6-membered heterocyclic group or a condensed heterocyclic group, for example, 4-pyridyloxy and 2-quinolyloxy, etc., a phosphate group, a thiophosphate group, a carbamoyloxy group, a thiocarbamoyloxy group, an oxamoyloxy group, a thiooxamoyloxy group, and the like.

Preferred coupling off groups for Z which are bonded to the coupling position through a sulfur atom include, for example, a thiocyano group, an alkylthio group, preferably having 1 to 20 carbon atoms, an arylthio group wherein the aryl moiety preferably has 6 to 12 carbon atoms and comprises a single or condensed ring, a heterocyclic thio group (preferably a heterocyclic thio group having a 5- or 6-membered heterocyclic group or a condensed heterocyclic group, for example, 5-tetrazolylthio, 2-benzimidazolylthio, 2-benzthiazolylthio, 2-thiazolylthio, 1,2,4-triazol-3-yl-thio and 2-benzoxazolylthio, etc.), an alkylsulfinyl group, preferably having 1 to 20 carbon atoms, an arylsulfinyl group, where the aryl moiety preferably has 6 to 12 carbon atoms and comprises a single or condensed ring, a heterocyclic sulfinyl group, preferably a heterocyclic sulfinyl group having a 5- or 6-membered heterocyclic group or a condensed heterocyclic group, for example, 2-benzimidazolylsulfinyl, 2-thiazolylsulfinyl, 2-benzothiazolylsulfinyl and 2-benzoxazolylsulfinyl, etc., an alkylsulfonyl group, preferably having 1 to 20 carbon atoms, an arylsulfonyl group, wherein the aryl moiety preferably has 6 to 12 carbon atoms and comprises a single or condensed ring, a heterocyclic sulfonyl group, preferably a heterocyclic sulfonyl group having a 5- or 6-membered heterocyclic group or a condensed heterocyclic group, for example, 2-benzimidazolylsulfonyl, 2-thiazolylsulfonyl, 2-benzthiazolylsulfonyl and 2-benzoxazolylsulfonyl, etc., a sulfo group, an alkylsulfonylthio group, preferably having 1 to 20 carbon atoms, an arylsulfonylthio group, wherein the aryl moiety preferably has 6 to 12 carbon atoms and comprises a single or condensed ring, a disulfido group, a sulfido group, a thiocarbamate group, a dithiocarbamate group, a thiocarbonate group, a dithiocarbonate group, and the like.

Preferred coupling off groups for Z which are bonded to the coupling position through a nitrogen atom include, for example, an acylamino group, preferably having 2 to 20 carbon atoms, an imido group, preferably having 3 to 20 carbon atoms, a sulfonamido group, a sulfinamido group, an alkylamino group, preferably having 1 to 20 carbon atoms, an arylamino group, wherein the aryl moiety preferably has 6 to 12 carbon atoms and comprises a single or condensed ring, a ureido group, a thioureido group, a phosphoric amido group, a urethane group, a thioacylamino group, preferably having 2 to 20 carbon atoms, an isocyanate group, and the like, and a nitrogen containing 5- or 6-membered heterocyclic ring (containing a maximum of 4 nitrogen atoms, for example, a cycloamino ring such as pyrrolidine, morpholine, piperazine, indoline, piperidine, etc., a cyclic diacylamino ring such as phthalimide, succinimide, saccharin, oxazolidione, thiohydantoin, hydantoin, etc., a cycloamido ring such as pyridone, oxazolidone, phthalide, valerolactam, etc., an aromatic cycloamino ring such as imidazole, pyrrole, benzotriazole, etc.), and the like.

In one most preferred embodiment of the color photographic light-sensitive material according to the present invention, a magenta coupler for forming a magenta dye image is incorporated into a silver halide emulsion layer. A coupler incorporated in the emulsion layer is preferably non-diffusible (diffusion resistant) in the emulsion binder matrix.

In order to render a coupler non-diffusible, a group containing a hydrophobic residue of 8 to 32 carbon atoms is introduced into the coupler molecule. This residue is generally called a ballast group. The ballast group can be combined with the coupler skeleton directly or through an imino bond, an ether bond, a carbonamido bond, a sulfonamido bond, a ureido bond, an ester bond, an imido bond, a carbamoyl bond, a sulfamoyl bond, and the like.

Specific examples of ballast groups are illustrated below:

(1) Alkyl groups or alkenyl groups:

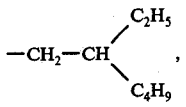

$-C_{12}H_{25}$, $-C_{16}H_{33}$, $-C_{17}H_{33}$, etc.

(2) Alkoxyalkyl groups:

$-(CH_2)_3-O-(CH_2)_7CH_3$, $-(CH_2)_3OCH_2-\underset{\underset{C_2H_5}{|}}{CH}-(CH_2)_8-CH_3$, etc., as disclosed in, for example, Japanese patent publication No. 27563/64.

(3) Alkylaryl groups:

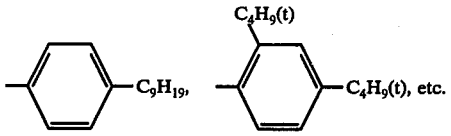

(4) Alkylaryloxyalkyl groups:

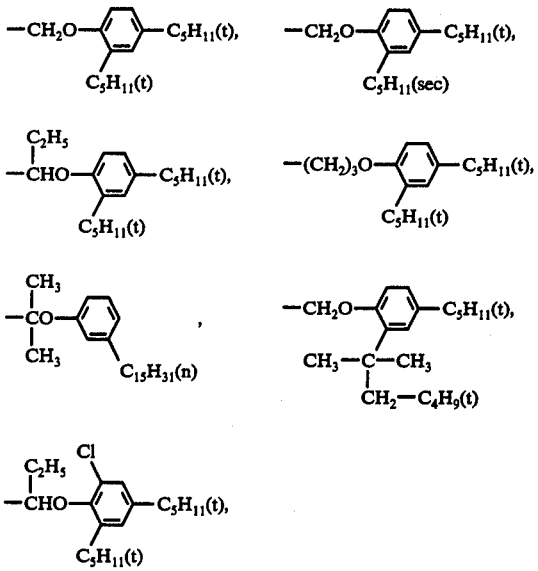

etc., as disclosed in, for example, U.S. Pat. Nos. 2,875,057, 3,062,653 and 2,474,293 and Japanese patent application No. 69383/73.

(5) Acylaminoalkyl groups:

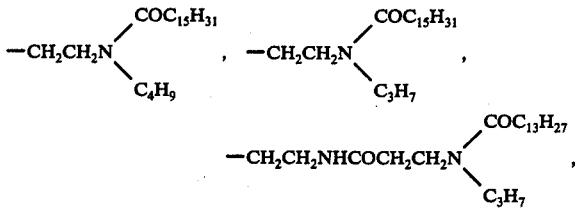

etc., as disclosed in, for example, U.S. Pat. Nos. 3,337,344 and 3,418,129, etc.

(6) Alkoxyaryl and aryloxyaryl groups:

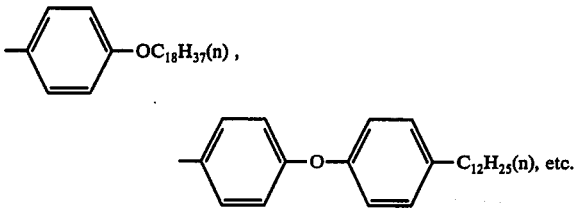

(7) Residues containing both a long chain aliphatic group such as an alkyl or alkenyl group and a water soluble group such as a carboxy or sulfo group:

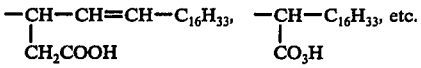

(8) Ester substituted alkyl groups:

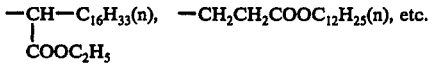

(9) Alkyl groups substituted with aryl groups or heterocyclic groups:

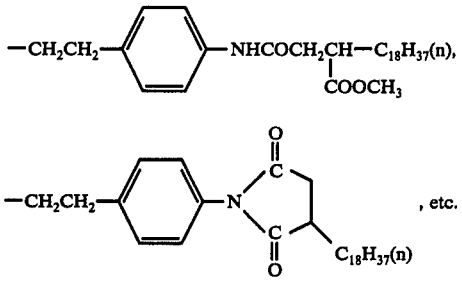

(10) Aryl groups substituted with aryloxyalkoxycarbonyl groups:

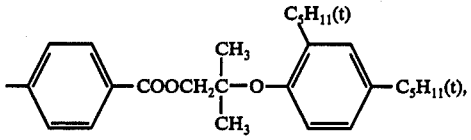

etc., as disclosed in, for example, Japanese patent application No. 35379/73.

Some examples of ballast groups are shown in specific examples of the couplers according to the present invention set forth hereinafter.

The couplers represented by General Formula (I) and (II) of the present invention include symmetrical and non-symmetrical complex couplers combined directly at T, X, W or Z with each other or through a divalent group derived from T, X, W or Z.

Examples of magenta couplers useful in the present invention are illustrated in the following. However, the invention is not to be construed as limited to these specific examples.

Cp-1

1-(2,4,6-Trichlorophenyl)-3-{3-[α-(2,4-di-tertamylphenoxy)butyramido]benzamido}-5-oxo-2-pyrazoline Cp-2

1-(2,4,6-Trichlorophenyl)-3-[3-(α-ethoxycarbonyloctadecanamido)benzamido]-5-oxo-2-pyrazoline Cp-3

1-(2,4-Dimethyl-6-chlorophenyl)-3-{3-[(2,4-di-tert-amylphenoxy)acetamido]benzamido}-5-oxo-2-pyrazoline Cp-4

1-(2,4,6-Trichlorophenyl)-3-{3-[(2,4-di-tert-amylphenoxy)acetamido]benzamido}-5-oxo-2-pyrazoline-4-yl-benzylcarbonate Cp-5

1-[4-(4-tert-amylphenoxy)phenyl]-3-[α-(4-tert-amylphenoxy)propionamido]-5-oxo-2-pyrazoline Cp-6

1-(2,4,6-Trichlorophenyl)-3-(2-chloro-5-tetradecanamido)anilino-5-oxo-2-pyrazoline Cp-7

1-(2,6-Dichloro-4-methoxyphenyl)-3-{2-chloro-5-[α-(2,4-di-tert-amylphenoxy)butyramido]anilino}-4-phenylthio-5-oxo-2-pyrazoline Cp-8

1-(2,6-Dichloro-4-methoxyphenyl)-3-{3-[α-(3-n-pentadecylphenoxy)butyramido]benzamido}-5-oxo-2-pyrazoline Cp-9

1-(2,4-Dimethyl-6-chlorophenyl)-3-{3-[β-dodecyloxycarbonyl)propionamido]benzamido}-5-oxo-2-pyrazoline Cp-10

1-(2,4,6-Trichlorophenyl)-3-{2-chloro-5-[α-(4-methoxyphenoxy)tetradecanamido]anilino}-5-oxo-2-pyrazoline Cp-11

1-(2,4,6-Trichlorophenyl)-3-{3-[α-(2,4-di-tert-amylphenoxy)butyramido]benzamido-4-imidazolyl}-5-oxo-2-pyrazoline Cp-12

1-(2,4,6-Trichlorophenyl)-3-{2-chloro-5-[α-(3,5-di-tert-butyl-4-hydroxyphenoxy)tetradecanamido]anilino}-5-oxo-2-pyrazoline Cp-13

1-(2,6-Dichloro-4-methylphenyl)-3-{3-[(3-n-pentadecylphenoxy)acetamido]benzamido}-5-oxo-2-pyrazoline Cp-14

1-(2,4,6-Trichlorophenyl)-3-{γ-[2-hydroxy-3-(2-benzotriazolyl)-5-n-pentylphenyl]butyramido}-5-oxo-2-pyrazoline Cp-15

1-(2,4,6-Trichlorophenyl)-3-{2-chloro-5-[β-dodecyloxycarbonyl)ethylcarbonyl]anilino}-5-oxo-2-pyrazoline Cp-16

1-(2,4,6-Trichlorophenyl)-3-[3-(dodecylureido)benzamido]-5-oxo-2-pyrazoline

Cp-17

1-(2,4,6-Trichlorophenyl)-3-[α-(2,4-di-tert-amylphenoxy)butyramido]-4-pentafluorobenzamido-5-oxo-2-pyrazoline Cp-18

1-(2,6-Dichloro-4-tetradecyloxycarbonylphenyl)-3-(2-chloro-5-methoxycarbonylanilino)-5-oxo-2-pyrazoline Cp-19

1-(2,4,6-Trichlorophenyl)-3-(α-carboxymethyl-n-2-eicosenamido)benzamido-5-oxo-2-pyrazoline Cp-20

1-{4-[(2,4-Di-tert-amylphenoxy)acetamido]phenyl}-3-(3-acetamido-benzamido)-5-oxo-2-pyrazoline Cp-21

1-(2,4,6-Trichlorophenyl)-3-{3-[(2-tetradecyl-4-chlorophenoxy)acetamido]benzamido}-5-oxo-2-pyrazoline Cp-22

1-(2,4-Dimethyl-6-chlorophenyl)-3-{3-[α-(2,4-di-tert-amylphenoxy)butyramdio]phenylureido}-5-oxo-2-pyrazoline Cp-23

1-(2,4,6-Trichlorophenyl)-3-{3-[α-(2,4-di-tertamylphenoxy)butyramdio]benzamido}-4-phenylsulfonamido-5-oxo-2-pyrazoline Cp-24

1-(2,4,6-Trichlorophenyl)-3-{2-chloro-5-[α-(3-tertbutyl-4-hydroxyphenoxy)tetradecanamido]anilino}-5-oxo-2-pyrazoline Cp-25

1-(2,4,6-Trichlorophenyl)-3-{2-chloro-5-[β-(2,2-dimethyl-6-hydroxy-7-tert-octyl-4-chromanyl)propionamido]anilino}-5-oxo-2-pyrazoline Cp-26

2-{3-[α-(2,4-Di-tert-amylphenoxy)butyramido]benzamido}-7-chloropyrazolo-[1,5*a*]-benzimidazole Cp-27

1-(2,4,6-Trichlorophenyl)-3-{[2-chloro-5-(3,5-dicarboxyphenoxy-acetamido)]anilino}-4-[(4-N-methyl-N-octadecyl-sulfamoyl)phenoxy]-5-oxo-2-pyrazoline Cp-28

1-(2-Methylphenyl)-3-(3,5-dicarboxyanilino)-4-(3-octadecylcarbamoylphenylthio)-5-oxo-2-pyrazoline Cp-29

1-(2,6-Dichloro-4-methoxycarbonylphenyl)-3-{3-[α-(3-pentadecylphenoxy)butyramido]benzamido}-5-oxo-2-pyrazoline Cp-30

1-(2,4,6-Trichlorophenyl)-3-{3-[(2,4-di-tert-amylphenoxy)acetamido]benzamido}-4-(4-methoxyphenylazo)-5-oxo-2-pyrazoline Cp-31

1-(2,4,6-Trichlorophenyl)-3-(2-chloro-5-tetradecanamidoanilino)-4-(3-methyl-4-hydroxyphenylazo)-5-oxo-2-pyrazoline Cp-32

1-(2,4,6-Trichlorophenyl)-3-{2-chloro-5-[3-(2-dodecylcarbamoylethylthio)propanamido]anilino}-5-oxo-2-pyrazoline The light fastness improving phenolic agent used in the present invention is a phenolic compound having the property of improving the light fastness of a magenta dye, and includes generally a phenol derivative in which at least one of the ortho positions to the hydroxy group thereof is substituted with a tertiary alkyl group, preferably having 4 to 24 carbon atoms, a bisphenol derivative, preferably a bisphenol derivative of the formula

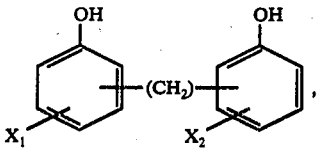

wherein $X_1$ and $X_2$ each can represent a hydrogen atom, an alkyl group having 1 to 20 carbon atoms, an aryl group having 6 to 12 carbon atoms and comprises a single or condensed ring or an alkoxy group having 1 to 20 carbon atoms, a phosphoric acid ester of a phenol derivative, preferably a phosphoric acid ester of a phenol derivative wherein the phenol derivative is a phenol which can be substituted with an alkyl group (1 to 20 carbon atoms), an alkoxy group (1 to 20 carbon atoms) or an aryl group (6 to 12 carbon atoms, comprising a single or condensed ring) or a halophenol, a polycyclic phenol derivative, preferably a polycyclic phenol derivative of the formula

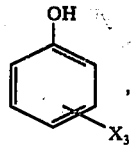

wherein $X_3$ represents an alkyl group having 1 to 20 carbon atoms, an aryl group having 6 to 12 carbon atoms comprising a single or condensed ring or an alkoxy group having 1 to 20 carbon atoms, a phenol derivative in which the para position to the hydroxy group is substituted with an oxygen atom and a 5- or 6-membered ring formed together with the oxygen atom is fused to the phenol nucleus, preferably a phenol derivative such as a 4-substituted phenol where the 4-position is substituted with an alkoxy group having 1 to 24 carbon atoms and comprising a straight chain or branched chain alkenyloxy group having 2 to 24 carbon atoms, an alkynyloxy group having 2 to 24 carbon atoms or a cycloalkoxy group having 5 to 10 carbon atoms which can include terpenes (for example, cyclohexyloxy and norbornyloxy), and the like.

Specific examples of the phenolic compounds are described, for example, in the above described prior art, that is, in U.S. Pat. Nos. 3,432,300, 3,573,050, 3,574,627, 3,764,337, 3,698,909, 2,146,668 and 3,519,429, Japanese patent publications Nos. 31625/1973, 31626/1973 and 31256/1973 (U.S. Pat. No. 3,700,455), Japanese patent applications (OPI) Nos. 26133/1973, 6338/1975, 6339/1975 and 134326/1974, U.S. Pat. No. 2,735,765, etc.

Typical examples of the compounds described in the specifications of the above patents are illustrated in the following.

Compound 1

4-(4-Methoxyphenylthio)phenol

Compound 2

Ethyl gallate

Compound 3

2,2'-Dihydroxy-5,5'-dimethyldiphenylsulfoxide

Compound 4

3,3'-Di-(tert-butyl)-2,2'-dihydroxy-5,5'-dimethyldiphenyldisulfide

Compound 5

3,3'-Di-(tert-butyl)-2,2'-dihydroxy-5,5'-dimethyldiphenylsulfone

Compound 6

2,2'-Cyclohexylidenebis-(6-tert-butyl-4-methylphenol)

Compound 7

2,6-Bis-(3-tert-butyl-2-hydroxy-5-methylbenzyl)-4-methylphenol

Compound 8

2,6-Di-tert-butyl-4-(β-n-octyloxycarbonylethylthiomethyl)phenol

Compound 9

2-Tert-butyl-4-octyloxyphenol

Compound 10

1,4-Bis-[3-(3,5-di-tert-butyl-4-hydroxyphenyl)propionyloxy]butane

Compound 11

Octadecyl (3,5-di-tert-butyl-4-hydroxyphenyl)propionate

Compound 12

4-{[4,6-Bis-(ethylthio)-s-triazin-2-yl]amino}-2,6-di-tert-butylphenol

Compound 13

Tris-(3,5-di-tert-butyl-4-hydroxyphenyl)phosphate

Compound 14

2,2'-Isopropylidenebis-(6-tert-butyl-4-methylphenol)

Compound 15

4,4'-Benzylidenebis-(2,6-di-tert-butylphenol)

Compound 16

4,4'-Ethylidenebis-(2-n-octyl-5-methylphenol)

Compound 17

2,6-Di-tert-butyl-4-methylphenol

Compound 18

4,4'-Bis-(2-tert-amyl-5-methylphenol)

Compound 19

Tetrakis-[3-(4-hydroxy-3,5-di-tert-butyl)phenylpropionylmethyl]urethane

Compound 20

2,2'-Methylenebis-(5-tert-butyl-4-methoxyphenol)

Compound 21

2,2'-Isobutylidenebis-(4-methoxyphenol)

Compound 22

2,6-Di-tert-butyl-α-dimethylamino-p-cresol

Light fastness improving phenolic agents particularly useful to the present invention are those represented by the following General Formula (III):

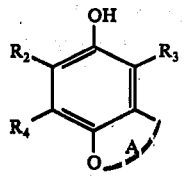

(III)

wherein $R_2$, $R_3$ and $R_4$, which may be the same or different, each represents a hydrogen atom, an alkyl group (preferably having 1 to 20 carbon atoms, for example, methyl, tert-butyl, octyl, dodecyl, octadecyl, etc.), a cycloalkyl group (preferably a mono-cycloalkyl group having 5 to 7 carbon atoms, for example, cyclopentyl, cyclohexyl, etc.), an alkoxy group (preferably having 1 to 20 carbon atoms, for example, methoxy, butoxy, dodecyloxy, etc.), an aryl group (preferably having 6 to 12 carbon atoms and comprises a single or condensed ring, for example phenyl, etc.), an aryloxy group (preferably having 6 to 12 carbon atoms and comprises a single or condensed ring, for example phenoxy, etc.), an aralkyl group (preferably having 7 to 12 carbon atoms and comprises a single or condensed ring, for example benzyl, phenethyl, etc.), an aralkoxy group (preferably having 7 to 12 carbon atoms and comprises a single or condensed ring, for example, benzyloxy, phenethyloxy, etc.), an alkenyl group (preferably having 1 to 20 carbon atoms, for example, allyl, etc.), an alkenoxy group (preferably having 1 to 20 carbon atoms, for example, allyloxy, etc.), an acylamino group (preferably having 2 to 20 carbon atoms, for example, acetylamino, benzoylamino, etc.), a halogen atom (for example, chlorine, etc.), an alkylthio group (preferably having 1 to 20 carbon atoms, for example, dodecylthio, etc.), an imido group (preferably having 3 to 20 carbon atoms, for example, succinimido, hydantoinyl, etc.), an acyl group, preferably having 2 to 20 carbon atoms, a sulfonamido group, an alkylamino group, preferably having 1 to 20 carbon atoms, an alkoxycarbonyl group, wherein the alkoxy moiety preferably has 1 to 20 carbon atoms, or an acyloxy group, preferably having 2 to 20 carbon atoms; and A represents the non-metallic atoms (such as a carbon atom, oxygen atom, sulfur atom and a nitrogen atom) necessary to form a 5- or 6-membered ring containing a —C=C—O— moiety, which ring can be substituted with an alkyl group (preferably having 1 to 20 carbon atoms, for example, methyl, tert-butyl, cyclohexyl, octyl, dodecyl, octadecyl, etc.), an alkoxy group (preferably having 1 to 20 carbon atoms, for example, methoxy, butoxy, dodecyloxy, etc.), an aryl group (preferably having 6 to 12 carbon atoms and comprises a single or condensed ring, for example, phenyl, etc.), an aryloxy group (preferably having 6 to carbon atoms and comprises a single or condensed ring, for example, phenoxy, etc.), an aralkyl group (preferably having 7 to 12 carbon atoms and comprises a single or condensed ring, for example, benzyl, phenethyl, etc.), an aralkoxy group (preferably having 7 to 12 carbon atoms and comprises a single or condensed ring, for example, benzyloxy, phenethyloxy, etc.), an alkenyl group (preferably having 1 to 20 carbon atoms, for example, allyl, etc.), an alkenoxy group (preferably having 1 to 20 carbon atoms, for example, allyloxy, etc.), an N-substituted amino group (wherein the substituent is preferably an alkyl group (1 to 20 carbon atoms), an aryl group (6 to 12 carbon atoms), an alkylene group (4 to 6 carbon atoms), an oxydialkyl group (3 to 5 carbon atoms), an iminodialkyl group (3 to 5 carbon atoms) or a thiodialkyl group (3 to 5 carbon atoms), for example, alkylamino wherein the alkyl moiety has 1 to 20 carbon atoms, dialkylamino, where an alkyl moiety has 1 to 20 carbon atoms, N-alkyl-N-arylamino, where the alkyl moiety preferably has 1 to 20 carbon atoms and the aryl moiety preferably has 6 to 12 carbon atoms and comprises a single or condensed ring, piperazino, morpholino, etc.), or a heterocyclic group (preferably a 5- or 6-membered heterocyclic group or a condensed heterocyclic group containing a nitrogen atom, an oxygen atom or a sulfur atom as a hetero atom, for example, benzothiazolyl, benzoxazolyl, imidazolyl, oxazolyl, etc.), and the like.

Further, the aforesaid ring can be substituted with a residue forming a condensed ring, i.e., the aforesaid ring formed by A can be condensed with a 5- or 6-membered cycloalkane, a 5- or 6-membered cycloalkane, a benzene ring or a naphthalene ring. Also, the alkyl group and the aryl group as described above can be substituted with a halogen atom, a hydroxy group, a carboxy group, an alkoxycarbonyl group, preferably wherein the alkoxy moiety has 1 to 20 carbon atoms, an acyloxy group, preferably having 2 to 20 carbon atoms, a sulfo group, a sulfonyloxy group, an amido group containing an acyl group which comprises an alkylcarbonyl moiety in which the alkyl moiety preferably contains 1 to 20 carbon atoms, an arylcarbonyl moiety in which the aryl moiety may be a single or condensed ring and preferably contains 6 to 12 carbon atoms, an alkylsulfonyl moiety in which the alkyl moiety preferably contains 1 to 20 carbon atoms, an arylsulfonyl moiety in which the aryl moiety may be a single or condensed ring and preferably contains 6 to 12 carbon atoms (for example, acetamido, ethanesulfonamido, benzamido, etc.), an alkoxy group, preferably having 1 to 20 carbon atoms, an aryloxy group, preferably having 6 to 12 carbon atoms and comprising a single or condensed ring, etc.

The compounds represented by General formula (III) include compounds in which two or more compounds are bonded through a divalent group derived from $R_2$, $R_3$, $R_4$ or A, for example a bis compound.

Furthermore, the compounds represented by General Formula (III) include a bisspiro compound containing a 5- or 6-membered ring with A. Of these compounds, particularly useful bisspiro compounds for use in the present invention are represented by the following General Formula (IV):

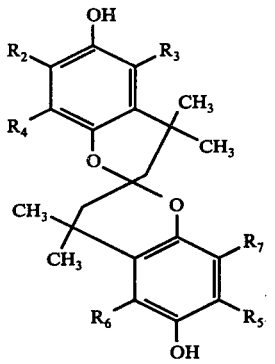

(IV)

wherein $R_2$, $R_3$, $R_4$, $R_5$, $R_6$ and $R_7$, which can be the same or different, each has the same meaning as defined for $R_2$ in General Formula (III).

The compounds represented by General Formula (III) in which the total carbon atoms of $R_2$, $R_3$, $R_4$ and A is larger than 8, and the compounds represented by General Formula (IV), have the property of low diffusibility, and, hence, are suitable for selective positioning in a specific hydrophilic layer of a photographic light-sensitive material. Also, phenolic compounds having a total number of carbon atoms of up to about 40 are suitable for ordinary purposes.

The 5-hydroxycoumarans, the 6-hydroxychromans and the hexahydrodibenzofuran-5-ols of General Formula (III) and the 6,6'-dihydroxy-bis-2,2'-spirochromans of General Formula (IV) are particularly valuable. More particularly, the compounds represented by General Formulae (III) or (IV) where $R_2$, $R_3$, $R_4$, $R_5$, $R_6$ and $R_7$ are an alkyl group, preferably of 1 to 20 carbon atoms, a cycloalkyl group, preferably of 5 to 7 carbon atoms, an alkoxy group, preferably of 1 to 20 carbon atoms, an aryl group, preferably of 6 to 12 carbon atoms and comprises a single or condensed ring, an aryloxy group, preferably of 6 to 12 carbon atoms and comprises a single or condensed ring, or an alkylthio group, preferably of 1 to 20 carbon atoms, are preferred Specific examples of the light fastness improving phenolic compounds represented by General Formulae (III) or (IV) which can be used in the present invention are shown in the following. However, the invention is not to be construed to be limited to these specific examples.

Compound 23

2,2-Dimethyl-4-methyl-6-hydroxy-7-tert-octylchroman

Compound 24

2-Methyl-2-n-octyl-6-hydroxy-7-tert-butylchroman

Compound 25

2,2-Dimethyl-4-isopropyl-5-methyl-6-hydroxy-7-methoxychroman

Compound 26

2-Methyl-2-n-octyl-4-[δ-(N-methylcarbamoyl)butyl]-6-hydroxy-7-tert-butylchroman

Compound 27

4,4,4',4'-Tetramethyl-6,6'-dihydroxy-7,7'-dimethyl-bis-2,2'-spirochroman

Compound 28

2-(N-Butylanilino)-3-methyl-5-hydroxy-6-tert-octyl-coumaran

Compound 29

2-Morpholino-3,3-dimethyl-5-hydroxy-6-tert-butyl-courmaran

Compound 30

2,2-(β,β-Dimethyl)pentamethylene-7-cyclohexyl-6-hydroxychroman

Compound 31

5a,6,7,7,9,9a-Hexahydro-5a-isopropyl-8-methyl-3-tert-octyl-5-dibenzofuranol

Compound 32

2,2-(β-Isopropyl)tetramethylene-7-tert-octyl-6-hydroxychroman

Compound 33

2-(N'-Ethoxycarbonyl-N-piperazino)-3,3-dimethyl-6-tert-butyl-5-hydroxycoumaran

Compound 34

4,4,4',4'-Tetramethyl-6,6'-dihydroxy-7,7'-di-tert-octyl-bis-2,2'-spirochroman

Compound 35

4,4,4',4'-Tetramethyl-6,6'-dihydroxy-7,7'-diphenyl-bis-2,2'-spirochroman

Compound 36

2,2'-Dimethyl-6-hydroxy-7-n-dodecylthiochroman

Compound 37

2,2-(β,β-Dimethyl)pentamethylene-7-tert-butyl-8-methyl-6-hydroxychroman

Compound 38

2,2-Dimethyl-4-(ω-chlorononyl)-6-hydroxy-7-tert-butylchroman

Compound 39

α-Tocopherol

Compound 40

2-Tert-octyl-4,5-dimethylenedihydroxyphenol

Compound 41

2-n-Dodecyl-4,5-trimethylenedihydroxyphenol

Compound 42

2,2-Dimethyl-4-isopropyl-5,7-di-tert-butyl-6-hydroxychroman

Compound 43

6,6'-Dihydroxy-4,4,4',4',5,5',7,7'-octamethyl-bis-2,2'-spirochroman

Compound 44

6,6'-Dihydroxy-4,4,4',4'-tetramethyl-5,5',7,7'-tetra-tert-butyl-bis-2,2'-spirochroman The light fastness improving phenolic agents which can be used in the present invention can be prepared according to the methods described in, for example, U.S. Pat. Nos. 2,535,058, 3,184,457, 3,285,937, 3,432,300, 3,573,050, 3,574,627, 3,764,337, 2,735,765 and 3,700,455, Japanese patent publication Nos. 31625/1973 and 31626/1973, Japanese patent applications (OPI) Nos. 6338/1975, 6339/1975, 134326/1974, 26133/1973 and 23822/1975, etc.

The synergistic light fastness improving sulfide or sulfoxide agents which can be used in the present invention are represented by the following General Formula (V):

$$X—B—Y \qquad (V)$$

wherein B represents —S— or —SO—; X and Y, which may be the same or different, each represents $—(CH_2)_n—R_1$,

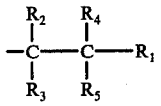

or

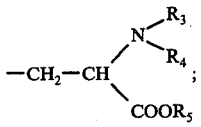

wherein $R_1$ represents $—COOR_3$,

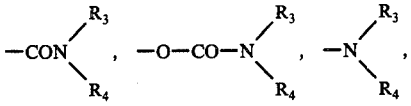

$—O—R_6$, $—O—COR_6$, $—NHSO_2R_6$,

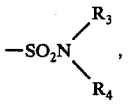

$—NH—CO—R_6$, a cyano group, an aryl group (preferably an aryl group having 6 to 12 carbon atoms which can be substituted with an alkyl group, a halogen atom, a hydroxy group, an alkoxy group, an aryl group or a cycloalkyl group, for example, phenyl, p-methylphenyl, etc.) or a hydroxy group; $R_2$ represents an alkyl group of 1 to 30 carbon atoms (for example, methyl, pentyl, dodecyl, octadecyl, etc.), an aryl group (preferably an aryl group as defined for X and Y above, for example, phenyl, m-chlorophenyl, etc.), an aralkyl group (for example, benzyl, phenethyl, etc.), a hydroxy group, a cyano group or $—COOR_3$; $R_3$, $R_4$, $R_5$ and $R_6$ each represents a hydrogen atom, an alkyl group of 1 to 30 carbon atoms (for example, methyl, butyl, decyl, hexadecyl, etc.), an aryl group (preferably an aryl group as defined for X and Y above, for example, phenyl, o-methylphenyl, etc.) or an aralkyl group (preferably an aralkyl group having 7 to 15 carbon atoms wherein the alkylene moiety has 1 to 4 carbon atoms (a methylene moiety can be substituted with an alkyl group) and the aryl moiety can be substituted with a halogen atom, a hydroxy group, a lower alkyl group or lower alkoxy group, for example, benzyl, phenethyl, p-isopropylbenzyl, etc.), with the proviso that $R_6$ is not a hydrogen atom; and $n$ is an integer of 1 to 4.

Specific examples of the synergistic light fastness improving agents represented by General Formula (V) which can be used in the present invention are shown in the following. However, the invention is not to be construed to be limited to these specific examples.

Compound 101

Bis-β-phenylethylsulfide

Compound 102

Bis-β-n-octyloxycarbonylethylsulfide

Compound 103

Bis-β-dimethylaminoethylsulfide

Compound 104

Bis-β-hydroxyethylsulfide

Compound 105

Bis-β-amino-β-carboxyethylsulfide

Compound 106

Bis-α-methyl-β-n-dodecyloxycarbonylethylsulfide

Compound 107

Bis-β-methyl-β-n-octadecyloxycarbonylethylsulfide

Compound 108

Bis-β-ethoxycarbonylbutylsulfide

Compound 109

Bis-β-methylcarbonyloxyethylsulfide

Compound 110

Bis-n-octadecyloxycarbonylmethylsulfide

Compound 111

Bis-β-cyanoethylsulfide

Compound 112

Bis-β-n-dodecyloxycarbonylethylsulfide

Compound 113

Bis-β-n-octadecyloxycarbonylethylsulfide

Compound 114

Bis-β-phenylethylsulfoxide

Compound 115

Bis-β-cyanoethylsulfoxide

Compound 116

Bis-β-n-octadecyloxycarbonylethylsulfoxide

Compound 117

Bis-β-(4-hydroxy-3,5-di-tert-butylphenyl)carbamoylethylsulfide

Compound 118

Bis-(β,β-dimethyl-β-n-octyloxycarbonylethyl)sulfide

Compound 119

β-Ethoxycarbonylethyl-β′-m-pentadecylphenoxyethylsulfide

The synergistic light fastness improving agents represented by General Formula (V) of the present invention are known as degradation preventing agents for synthetic rubbers, synthetic resins or petroleum products, as described hereinbefore, and many such compounds are commercially available. Further, these compounds can be easily prepared according to the following method. That is, the sulfide compound can be easily obtained by heating a substituted alkyl halide and sodium sulfide in an organic solvent, for example, a high boiling point aprotic polar solvent such as dimethylsulfoxide, dimethylformamide, etc. The sulfoxide compound can easily be obtained by reacting a sulfide compound with an oxidizing agent such as hydrogen peroxide, etc., in an organic solvent, for example, acetone, etc.

In the practice of the present invention, one or more magenta couplers, e.g., those represented by General Formulae (I) or (II), can be used together with one or more of the light fastness improving phenolic agents and one or more of the synergistic light fastness improving agents represented by General Formula (V). Furthermore, light fading preventing agents or antioxidants other than the above described light fastness improving phenolic agents and synergistic light fastness improving agents can also be used, if desired.

Nucleus substituted hydroquinones, for example, those described in U.S. Pat. Nos. 2,336,327, 2,360,290, 2,384,658, 2,403,721, 2,418,613, 2,675,314, 2,701,197, 2,704,713, 2,710,801, 2,722,556, 2,728,659, 2,732,300, 2,735,765, 2,816,028, 3,062,884, and 3,236,893, British Pat. Nos. 557,750 and 557,802, German patent application (OLS) No. 2,149,789, Japanese patent publication No. 54116/1969, Japanese patent application (OPI) No. 2128/1971, *J. Org. Chem.*, Vol. 22, pages 772 to 774, etc., are suitable for use together with the phenolic agents and the synergistic agents. By using such combination according to the present invention, a magenta color image formed from a magenta coupler which has exceptionally improved light fastness is obtained, and, further, coloring of the coupler remaining in the color photographic material after processing due to the action of heat or or light can be effectively prevented.

When a photographic material containing a magenta coupler as is used in the present invention and a light fastness improving agent represented by General Formulae (III) or (IV) is stored at ordinary room temperature for several months, the color density obtained upon color development of the photographic material may tend to reduce in comparison with that obtained immediately after the production of the photographic material. However, such a reduction of color density can be prevented by using one or more nucleus substituted hydroquinones.

Specific examples of useful nucleus substituted hydroquinones include 2,5-di-tert-octylhydroquinone, 2,5-di-n-octylhydroquinone, 2-methyl-5-tert-octylhydroquinone, 2,6-di-n-dodecylhydroquinone, 2-n-dodecylhydroquinone, 2-dodecylcarbamoylmethylhydroquinone, 2-n-dodecyl-5-chlorohydroquinone, 2-β-[3-(3-sulfobenzamido)benzamido]ethylhydroquinone, 2,2'-methylenebis-5,5'-di-tert-butylhydroquinone, 2-dodecyloxycarbonylhydroquinone, and the like.

The nucleus substituted hydroquinines as are used in the present invention can be prepared by the methods as described in the above indicated patents such as U.S. Pat. No. 2,336,327, etc.

According to the present invention, a magenta coupler is used together with a light fastness improving phenolic agent and a synergistic light fastness improving agent and the nucleus substituted hydroquinone described above, if desired. However, in addition to these compounds, other antioxidizing agents such as those described in L. Reich and S. S. Stilva, *Autoxidation of Hydrocarbons and Polyolefins,* Marcel Dekker Inc. (1969), N. M. Emanuel and Yun Lyaskouskaya (translated by K. A. Allen), *The Inhibition of Fat Oxidation Processes,* Pergamor Press, W. O. Lumdberg, *Autoxidation and Autoxidants,* Interscience Publishers, etc., can be used, if desired.

The magenta coupler used in the present invention can be employed individually or as a combination thereof or further can be used, if desired, together with other colorless or colored two-equivalent or four-equivalent magenta color image forming coupler(s). Suitable examples of such other couplers include magenta couplers as described in, for example, U.S. Pat. Nos. 2,439,098, 2,369,489, 2,600,788, 3,558,319, 2,311,081, 3,006,759, 2,725,292, 3,408,194, 2,908,573, 3,519,429, 3,615,506, 3,432,521, 3,152,896, 3,062,653, 3,582,322, 2,801,171 and 3,311,476, British Pat. No. 956,261, Japanese patent publication Nos. 2016/1969 and 19032/1971, Japanese patent applications (OPI) Nos. 74027/1974, 13041/1975, 111631/1974 and 74028/1974, Japanese patent application (OPI) Nos. 108798/1973, etc., magenta colored couplers as described in, for example, U.S. Pat. Nos. 2,983,608, 2,455,170, 2,725,292, 3,005,712, 3,519,429 and 2,688,539, British Pat. Nos. 800,262 and 1,044,778, Belgian Pat. No. 676,691, Japanese patent application (OPI) No. 131448/1974, etc., the so-called DIR couplers capable of image-wise releasing a compound inhibiting development during development, for example, a monothio type coupler as described in U.S. Pat. Nos. 3,227,550 and 3,227,554 and British Pat. No. 953,454, an o-aminophenylazo type coupler as described in U.S. Pat. No. 3,148,062, a coupler as described in Japanese patent publication No. 8750/1972 and German patent application (OLS) No. 2,163,811, etc., and a hydroquinone capable of releasing a compound inhibiting development during development, for example, as described in U.S. Pat. No. 3,297,445 and British Pat. No. 1,058,606, etc.

Two or more of the above described compounds such as magenta couplers and the like can be incorporated in the same layer or the same compound can be incorporated in two or more layers in order to meet the characteristics required in the photographic light-sensitive material.

In general, the magenta couplers of the present invention are coated on a support in a range from about $1 \times 10^{-4}$ to about $5 \times 10^{-3}$ mol/m$^2$, preferably $3 \times 10^{-4}$ to $2 \times 10^{-3}$ mol/m$^2$.

The light fastness improving phenolic agents which can be used in the present invention can be used individually or as a combination of two or more such agents. The amount of the phenolic compound is, in general, about 0.01 mol to about 10 mols per mol of the magenta coupler(s), and a particularly preferred amount is about 0.1 mol to about 5 mols per mol of the magenta coupler(s).

Of the magenta couplers used in the present invention, the couplers described in U.S. Pat. No. 3,519,429, in which the light fastness improving phenolic compound of the present invention is bonded to the coupler skeleton, such as the above illustrated Cp-12, Cp-24 and Cp-25, or a coupler in which the synergistic light fastness improving agent of the present invention is bonded to the coupler skeleton, such as the above illustrated Cp-32, are considered to be equivalent to the situation where the magenta coupler and the light fastness improving phenolic agent or the synergistic light fastness improving agent are separately present according to the method of the present invention.

The nucleus substituted hydroquinones used in the present invention can be used individually or as a combination of two or more such compounds. The amount of the hydroquinone compound is usually about 0.01 to about 10 mols, particularly preferably about 0.1 to about 2 mols, per mol of the magenta coupler(s).

The ratio of the light fastness improving phenolic agent of the present invention and the synergistic light fastness improving agent represented by General Formula (V) of the present invention is about 0.01 mol to about 20 mols, preferably about 0.05 mol to about 5 mols, of the synergistic light fastness improving agent of General Formula (V) per mol of the light fastness improving phenolic agent. When the amount of the synergistic light fastness improving agent is excessively lower than about 1 mol% of the light fastness improving phenolic agent used, the synergistic light fastness improving effect may not be obtained satisfactorily. On the other hand, when the amount of the synergistic light fastness improving agent is excessively greater than about 20 times per mol of the light fastness improving phenolic agent used, a further improvement of the light fastness may not be expected and some disadvantages may be encountered in that it is difficult to disperse the compounds and in that the thickness of the layer containing the compounds increases.

The light fastness improving phenolic compound and/or the synergistic light fastness improving agent represented by General Formula (V) of the present invention can be added to a final stabilizing bath of a processing step, if desired. Needless to say, the compounds represented by General Formula (V) can be added to other baths, so long as the bath is the last treating bath in the processing. For example, when blixing is the last treatment, the compound can be added to the blixing bath. On the other hand, if fixing is the last treatment, the compound can be added to the fixing bath. The amount generally used is about 0.1 to about 50 g, preferably about 0.5 to about 30 g, per liter.

The nucleus substituted hydroquinones which can be used in the present invention can be incorporated into a layer, other than an emulsion layer containing the magenta coupler, e.g., an intermediate layer, a filter layer, a protective layer, another emulsion layer, etc., of a multilayer color photographic material, in order to prevent color contamination (the relationship where the complementary color between the spectral sensitivity and the color image formed is destroyed by exchange of the oxidation product of developing agent during development between one emulsion layer and another emulsion layer adjacent thereto, for example, when green light exposure is subjected, only magenta image must be formed but cyan and/or yellow images are also formed, which adversely affect color reproducibility), color fog or color stain.

According to the present invention, the magenta coupler, the light fastness improving phenolic agent, the synergistic light fastness improving agent represented by General Formula (V) and, if desired, the nucleus substituted hydroquinone, can be mixed to form a dispersion by dissolving a mixture of all four compounds, a mixture of any two or three compounds, or separately into either an organic solvent which has a high boling point (higher than 170° C.) and is immiscible with water, a low boiling point organic solvent and a water soluble organic solvent or a high boiling point water immiscible organic solvent and/or a low boiling point organic solvent and/or a water soluble organic solvent.

High boiling point water immiscible organic solvents as described in U.S. Pat. No. 2,322,027 can be used as the solvent, if desired. Examples of preferred solvent are di-n-butyl phthalate, benzyl phthalate, triphenyl phosphate, tri-o-cresyl phosphate, diphenyl mono-o-chlorophenyl phosphate, monophenyl di-o-chlorophenyl phosphate, dioctyl phthalate, dibutyl sebacate, acetyltributyl citrate, tri-tert-octyl trimellitate, n-nonylphenol, dioctyl butyl phosphate, N,N-diethyl laurylamide, 3-pentadecylphenyl ethyl ether, 2,5-di-sec-amylphenyl butyl ether, and the like.

Low boiling point (lower than 170° C.) or water soluble organic solvents which can be used together with or in place of the high boiling point solvent are described, e.g., in U.S. Pat. Nos. 2,801,171, 2,801,170, 2,949,360, etc. Examples of these organic solvents are as follows:

(1) An organic solvent which has a low boiling point and is substantially insoluble in water such as methyl, ethyl, propyl or butyl acetate, isopropyl acetate, ethyl propionate, secondary butyl alcohol, ethyl formate, butylformate, nitromethane, nitroethane, carbon tetrachloride, chloroform, and the like.

(2) A water soluble organic solvent such as methyl isobutyl ketone, β-ethoxyethylacetate, Carbitol acetate (diethyleneglycol monoacetate), methoxytriglycol acetate, acetyl acetone, diacetone alcohol, butyl Carbitol, methyl Carbitol, methyl ethyl ketone, methanol, ethanol, acetonitrile, dimethylformamide, dioxane, and the like. It is desirable for the solvent to have a sufficiently low water content so as to not adversely affect the solubility of the coupler, light fastness improving phenolic agent, synergistic light fastness improving agent and nucleus substituted hydroquinone used. Generally, no more than about 10% water (based on the weight of total solvent present) is desired.

If desired, the method for removing a low boiling or water soluble solvent from a coupler dispersion which comprises air drying the cooled noodle-like dispersion or continuously washing the cooled noodle-like dispersion with water as described in U.S. Pat. No. 2,801,171 can be used.

For the dispersion of an oil soluble coupler, an emulsifying homogenizer, a colloid mill, an ultrasonic wave emulsifying apparatus, and the like are suitably used. A diffusion resistant coupler having both a ballast group and a carboxylic acid group or a sulfonic acid group in the molecule is soluble in a neutral or weakly alkaline aqueous solution. The coupler can be incorporated in a photographic emulsion by adding such an aqueous solution containing the coupler to the photographic emulsion. The coupler is believed to be diffusion resistant through the formation of micelles in the hydrophilic polymer.

The magenta coupler, the light fastness improving phenolic agent, the synergistic light fastness improving agent and the nucleus substituted hydroquinone compound according to the present invention can be added to a photographic emulsion as separate solutions or dispersions or can be added to a photographic emulsion as a mixture of two, three or four kinds of solutions or dispersions thereof.

The magenta coupler, the light fastness improving phenolic agent, the synergistic light fastness improving agent and the nucleus substituted hydroquinone compound of the present invention can be dispersed using a water insoluble, organic solvent soluble polymer in place of a part or all of a high boiling point water immiscible organic solvent. Examples of such polymers are disclosed in U.S. Pat. Nos. 3,619,195, 2,852,382, 2,272,191, 2,269,158, etc.

According to one preferred embodiment of the present invention, the light fastness improving phenolic agent, the synergistic light fastness improving agent represented by General Formula (V) and the nucleus substituted hydroquinone having at least one substituent containing 8 or more carbon atoms are incorporated into the same oil droplets comprising a high boiling point water immiscible organic solvent and added to a silver halide emulsion containing the magenta color image forming coupler. In a more preferred embodiment of the present invention, all of the light fastness improving phenolic agent, the synergistic light fastness improving agent represented by General Formula (V), the nucleus substituted hydroquinone having at least one substituent containing 8 or more carbon atoms and the non-diffusible magenta color image forming coupler are incorporated into the same oil droplets and added to a silver halide photographic emulsion.

In the preparation of oil droplets, the ratio of the coupler, the light fastness improving agent, the synergistic light fastness improving agent and the nucleus substituted hydroquinone to the high boiling point water immiscible organic solvent and/or the low boiling or water soluble organic solvent is about 0.1 to about 20, preferably about 0.5 to about 10, by weight.

Silver halide emulsions are usually prepared by mixing a solution of a water soluble silver salt, for example, silver nitrate with a water soluble halide, for example, potassium bromide, in the presence of a water soluble polymer, for example, gelatin. In addition to silver chloride and silver bromide, mixed silver halides such as silver chlorobromide, silver iodobromide and silver chloroiodobromide can be employed in the present invention. The silver halide grains can be prepared according to conventional methods, including a single jet method, a double jet method and a controlled double jet method. Mixtures of two or more silver halide photographic emulsion which are prepared separately can also be used. The silver halide grains can have a homogeneous crystal structure, a layered structure in which the interior differs from the outer layer, or conversion type silver halide grains as described in British Pat. No. 635,841 and U.S. Pat. No. 3,622,318 can be used. Silver halide grains which form a latent image predominantly on the surface of the grains or predominantly in the interior of the grains can also be used. These photographic emulsions can be prepared by various known methods such as an ammonia method, a neutral method and an acid method.

The silver halide emulsion above described can be chemically sensitized using conventional methods, if desired. Specific examples of suitable chemical sensitizers include, for example, gold compounds such as chloroaurates and gold trichloride as described in U.S. Pat. Nos. 2,399,083, 2,540,085, 2,597,856 and 2,597,915, salts of a noble metal, such as platinum, palladium, iridium, rhodium and ruthenium, as described in U.S. Pat. Nos. 2,448,060, 2,540,086, 2,566,245, 2,566,263 and 2,598,079, sulfur compounds capable of forming silver sulfide by reacting with a silver salt, such as those described in U.S. Pat. Nos. 1,574,944, 2,410,689, 3,189,458 and 3,501,313, stannous salts, amines, and other reducing compounds such as those described in U.S. Pat. Nos. 2,487,850, 2,518,698, 2,521,925, 2,521,926, 2,694,637, 2,983,610 and 3,201,254, and the like.

Examples of the hydrophilic colloids used as a vehicle for the silver halide grains include, for example, gelatin, colloidal albumin, casein, a cellulose derivative such as carboxymethylcellulose and hydroxyethylcellulose, agar, sodium alginate, a starch derivative, a synthetic hydrophilic colloid such as polyvinyl alcohol, poly-N-vinyl pyrrolidone, a polyacrylic acid copolymer and polyacrylamide, or the derivatives or partially hydrolyzed products thereof. If desired, a compatible mixture of these colloids can also be used. Of these colloids, gelatin is most commonly employed. It can be replaced partially or completely by a synthetic polymer as described above, by a gelatin derivative (for example, phthalated gelatin, etc.) such as those prepared by reacting or modifying the amino, imino, hydroxy or carboxy groups contained, as functional groups, in the gelatin molecule with a compound having a group capable of reacting with the above described groups, or a graft gelatin such as those prepared by grafting other polymer chains onto the gelatin molecule.

The photographic emulsion can be spectrally sensitized or supersensitized, if desired, using a cyanine dye such as a cyanine, merocyanine, carbocyanine or styryl dye, individually or in combination. Such spectral sensitization techniques are well known and are described, for example, in U.S. Pat. Nos. 2,688,545, 2,912,329, 3,397,060, 3,615,635 and 3,628,964, British Pat. Nos. 1,195,302, 1,242,588 and 1,293,862, German patent applications (OPI) Nos. 2,030,326 and 2,121,780 and Japanese patent publications Nos. 4936/1968 and 14030/1969. The sensitizers can be chosen as desired depending on the spectral range, sensitivity, and the like considering the purposes and uses of the photographic materials to be sensitized.

To the photographic emulsion described above there can be added various kinds of conventional stabilizers or anti-fogging agents in order to prevent a reduction in the sensitivity or the formation of fog during preparation, storage or processing. A wide variety of such compounds are known such as heterocyclic compounds, mercury containing compounds, mercapto compounds or metal salts, including 4-hydroxy-6-methyl-1,3,3a,7-tetrazaindene, 3-methylbenzothiazole and 1-phenyl-5-mercaptotetrazole.

The photographic emulsion can be hardened using conventional methods. Examples of suitable hardeners include, for example, aldehyde type compounds such as formaldehyde and glutaraldehyde; ketone compounds such as diacetyl and cyclopentanedione; reactive halogen containing compounds such as bis(2-chloroethylurea), 2-hydroxy-4,6-dichloro-1,3,5-triazine and those described in U.S. Pat. Nos. 3,288,775 and 2,732,303 and British Pat. Nos. 974,723 and 1,167,207; divinylsulfone; 5-acetyl-1,3-diacryloyl-hexahydro-1,3,5-triazine; the compounds described in U.S. Pat. Nos. 3,635,718 and 3,232,763, British Pat. No. 994,869, U.S. Pat. Nos. 2,732,316, 2,586,168, 3,103,437, 3,017,280, 2,983,611, 2,725,294, 2,727,295, 3,100,704, 3,091,537, 3,321,313, 3,543,292, etc.

The photographic emulsion described above can also contain one or more surface active agents. These are used as a coating aid, a dispersing agent, a sensitizer, an agent for improving photographic properties, an antistatic agent or an adhesion preventing agent. The surface active agents can be classified as natural surface active agents such as saponin; nonionic surface active agents such as alkylene oxides, glycerols and glycidols; cationic surface active agents such as higher alkylamines, quaternary ammonium salts, heterocyclic compounds such as pyridine and the like, phosphoniums or sulfoniums; anionic surface active agents containing an acid group such as a carboxylic acid group, a sulfonic acid group, a phosphoric acid group, a sulfuric acid ester group or a phosphoric acid ester group; amphoteric surface active agents such as amino acids, aminosulfonic acids, aminoalcohol sulfuric acid esters or aminoalcohol phosphoric acid esters. Some examples of such surface active agents used are described, for example, in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German patent application (OPI) Nos. 1,942,665, British Pat. Nos. 1,077,317 and 1,198,450, and the like.

The color photographic light-sensitive material according to the present invention comprises a support having thereon a silver halide emulsion layer containing the magenta coupler, the light fastness improving phenolic agent and the synergistic light fastness improving agent. According to one embodiment of the present invention a multilayer, multicolor photographic light-sensitive material comprises a support having thereon a blue sensitive silver halide emulsion layer containing a yellow color forming coupler, a green sensitive silver halide emulsion layer containing a magenta color forming coupler, the light fastness improving phenolic agent and the synergistic light fastness improving agent of the present invention and a red sensitive silver halide emulsion layer containing a cyan color forming coupler.

As yellow color forming couplers, open chain diketomethylene compounds as are conventionally used can be used. Examples of such compounds are described, for example, in U.S. Pat. Nos. 3,341,331, 3,253,924, 3,384,657, 2,778,658, 2,908,573, 3,227,550, 2,875,057 and 3,551,155, German patent application (OPI) No. 1,547,868, U.S. Pat. Nos. 3,265,506, 3,582,322 and 3,725,072, German patent application (OPI) No. 2,162,899, U.S. Pat. Nos. 3,369,895, 3,227,155, 3,447,928, 3,415,652, and 3,408,194, German patent applications (OPI) Nos. 2,057,941, 2,163,812, 2,213,461, 2,219,917, 2,261,361 and 2,263,875, and the like.

As cyan couplers, phenol or naphthol derivatives as are conventionally used can be used. Examples of such compounds are described, for example, in U.S. Pat. Nos. 2,369,929, 2,474,293, 2,908,573, 2,619,196, 3,253,294, 3,227,550, 3,419,390, 3,476,563, 2,698,794, 2,895,826, 3,311,476, 3,458,315, 2,423,730, 2,801,171, 3,046,129, 3,516,831, 2,772,162, 3,560,212, 3,582,322, 3,591,383, 3,386,301, 3,632,347, 3,652,286, 3,779,763, 2,434,272, 2,706,684, 3,034,892 and 3,583,971, German patent applications (OPI) Nos. 2,163,811 and 2,207,468, Japanese patent publications No. 28836/1970 and 27563/1964, Japanese patent application No. 33238/1973, and the like.

Of these couplers, two-equivalent yellow or cyan color image forming couplers in which the carbon atom of the coupling positions is substituted with a substituent releasable upon coupling reaction are particularly preferred when the color photographic light-sensitive material containing the magenta coupling according to the present invention is subjected to rapid color processing or in order to obtain color images having high sharpness.

The photographic light-sensitive material according to the present invention can have, in addition to the silver halide emulsion layer, a light-insensitive auxiliary layer such as a protective layer, a filter layer, an intermediate layer, an antihalation layer, a backing layer, etc. Such layers are described in U.S. Pat. Nos. 3,726,681 and 3,516,831, British Pat. Nos. 818,687 and 923,045, German patent applications (OLS) Nos. 2,322,165 and 2,018,341, etc.

The color photographic light-sensitive material according to the present invention can contain, in a protective layer, an intermediate layer, an emulsion layer or a backing layer, an ultraviolet absorbing agent as described, for example, in U.S. Pat. Nos. 2,685,512, 2,739,888, 2,784,087, 3,253,921, 3,533,794, 3,738,837, 3,754,919 and 3,769,294, Japanese patent publication No. 26139/1974, etc.

The photographic emulsion can be coated on a substantially planar material which does not undergo severe dimensional changes during processing including a rigid support such as glass, metal or a ceramic, or a flexible support, as desired. Representative flexible supports include those generally used for photographic light-sensitive materials, such as a cellulose nitrate film, a cellulose acetate film, a cellulose acetate butyrate film, a cellulose acetate propionate film, a polystyrene film, a polyethylene terephthalate film, a polycarbonate film, a laminate of these polymers, a thin glass film and a paper. A baryta coated paper, a paper which is coated or laminated with an $\alpha$-olefin polymer, particularly those obtained from a monomer having from 2 to 10 carbon atoms, such as polyethylene, polypropylene and ethylene-butene copolymers, and a plastic film in which the adhesiveness to other polymers and the printing properties are improved by roughening its surfaces, such as described in Japanese patent publication No. 19068/1972, can also be used to advantage as a support.

These supports can be transparent or opaque, depending on the use of the photographic materials. Colored transparent supports which contain a dye or a pigment can also be used.

Examples of opaque supports include films produced by incorporating into a transparent film a dye or a pigment such as titanium oxide or surface treated plastic films such as those described in Japanese patent publication No. 19068/1972, as well as intrinsically opaque materials such as paper. Highly light shielding papers and plastic films containing, for example, carbon black or dyes can also be employed. When the adhesion between a support and a photographic layer is unsatisfactory, a subbing layer which adheres to both the support and the photographic layer can be provided on the support. The surface(s) of the support can also be pretreated by a corona discharge, an UV radiation treatment, a flame treatment and the like in order to further improve the adhesiveness.

The color photographic light-sensitive materials of the present invention are, after exposure, subjected to color processing to form dye images. The color processing basically includes a color development step, a bleaching step and a fixing step. Each step can be carried out individually or two or more steps can be combined in one step where a processing solution having the two or more functions is used. One example of such a combined bath is a blix bath. Also, each step can be divided into two or more sub-steps. For example, a process comprising a color development step, a first fixing step and a blixing step can be used. The color processing can further include a pre-hardening step, a neutralization step, a first development (black and white development) step, a stabilizing step, a washing step, and the like, if desired.

The temperature of processing can be varied depending upon the photographic light-sensitive material, the color processing method, and the like. In general, a temperature above 18° C. is used, although a temperature below 18° C. can be used. A temperature range of 20° to 60° C., recently 30° to 60° C., is often conveniently used. Each of these steps need not necessarily be conducted at the same temperature.

A color developer solution is an alkaline solution having a pH value of more than about 8, preferalby from 9 to 12, which contains a developing agent.

The developing agent described above is conventional and includes a compound capable of developing an exposed silver halide and having a primary amino group on an aromatic ring, and a precursor which can form such compound. Preferred typical examples of such developing agents are 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methane-sulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline, etc., and their salts (for example, the sulfates, the hydrochlorides, the sulfites, the p-toluene sulfonates, and the like).

The color developer solution can optionally contain various known additives. Typical examples of such additives include alkaline agents (for example, hydroxides, carbonates or phosphates of alkali metals or ammoniums); pH adjusting agents or buffers (for example, weak acids such as acetic acid, boric acid, etc., weak bases, or salts thereof); developing accelerators (for example, various pyridium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. Nos. 2,533,990, 2,577,127 and 2,950,970; nonionic compounds such as polythioethers represented by those described in British Pat. Nos. 1,020,033 and 1,020,032; polymeric compounds having sulfite ester groups such as those described in U.S. Pat. No. 3,068,097; organic amines such as pyridine and ethanolamine; benzyl alcohol; hydrazine and the like); anti-fogging agents (for example, alkali metal bromides, alkali metal iodides, nitrobenzimidazoles such as those described in U.S. Pat. Nos. 2,496,940 and 2,656,271, mercaptobenzimidazole, 5-methylbenzotriazole, 1-phenyl-5-mercaptotetrazole, compounds for use in rapid processing solutions such as those described in U.S. Pat. Nos. 3,113,864, 3,342,596, 3,295,976, 3,615,522, and 3,597,119, thiosulfonyl compounds such as those described in British Pat. No. 972,211, phenazine-N-oxides such as those described in Japanese patent publication No. 41675/1971, those described in *Kagaku Shashin Binran* (*Manual of Scientific Photography*), Vol. II, pages 29 to 47, and the like); stain or sludge preventing agents such as those described in U.S. Pat. Nos. 3,161,513 and 3,161,514 and British Pat. Nos. 1,030,422, 1,144,481 and 1,251,558; interlayer effect accelerators disclosed in U.S. Pat. No. 3,536,487; preservatives (for example, sulfites, bisulfites, hydroxylamine hydrochloride, formaldehyde-bisulfite adducts, alkanolamine-bisulfite adducts, etc.), and the like.

After color development, the light-sensitive material of the present invention is subjected to a bleaching in a conventional manner. The bleaching can be carried out per se or in combination with a fixing. The bleaching solution can contain a fixing agent to form a blix bath, if desired. As bleaching agents, many kinds of compounds are known. Of these compounds, ferricyanides, bichromates, water soluble cobalt (III) salts, water soluble copper (II) salts, water soluble quinones, nitrosophenol, complex salts of a polyvalent cation such as iron (III), cobalt (III) copper (II) and an organic acid, for example, an aminopolycarboxylic acid such as ethylenediamine tetraacetic acid, nitrilotriacetic acid, iminodiacetic acid, N-hydroxyethylethylenediaminetriacetic acid, etc., malonic acid, tartaric acid, malic acid, diglycollic acid and dithioglycollic acid, etc., a copper complex of 2,6-dipicolinic acid, peracids such as alkyl peracids, persulfates, permanganates and peroxides, hypochlorites, chlorine, bromine, bleaching powder, and the like can be suitably used, individually or in combination. To the bleaching solution, bleaching accelerators such as those described in U.S. Pat. Nos. 3,042,520 and 3,241,966, Japanese Patent Publications Nos. 8506/1970 and 8836/1970 and other various additives can be added.

The formation of dye images according to the present invention can be achieved in light-sensitive materials of various forms. In one form, a light-sensitive material having a silver halide emulsion layer containing a diffusion resistant coupler on a support is treated with an alkaline developer solution containing an aromatic primary amine color developing agent to retain water insoluble or diffusion resistant dye in the emulsion layer. In another form, a light-sensitive material having a silver halide emulsion layer in combination with a diffusion resistant coupler on a support is treated with an alkaline developer solution containing an aromatic primary amine color developing agent to form a dye soluble in an aqueous medium and diffusible therein which is then transferred to another image receiving layer of a hydrophilic colloid. This is a diffusion transfer color system. In the latter form, the light fastness improving phenolic agent, the synergistic light fastness improving agent and, if desired, the nucleus substituted hydroquinone are incorporated into an image receiving layer.

The color photographic light-sensitive material of the present invention is not especially limited, i.e., it includes a color negative film, a color positive film, a color reversal film, a color printing paper and any other kind of color photographic light-sensitive material.

The method of the present invention can be applied to a color photographic light-sensitive material containing relatively low amount of silver halide as described in German patent application (OPI) No. 2,357,914. For example, such a color photographic light-sensitive material includes silver halide from several tenths to one hundredth of that in conventional color photographic light-sensitive materials, i.e., from about 65 to about 375 mg/m² per layer.

The color photographic light-sensitive material containing silver halide in such a small amount provides a sufficiently high color density by a method in which developed silver formed by color development is halogenation-bleached and then color developed again to increase the amount of dye formed, as described, for example, in U.S. Pat. Nos. 2,623,822 and 2,814,565, etc., or a color intensification method using a peroxide as described, for example, in U.S. Pat. Nos. 3,674,490 and 3,761,265, German patent application (OPI) No. 2,056,360, Japanese patent applications (OPI) Nos. 6338/1972 and 10538/1972, etc., or using a cobalt complex salt as described, for example, in German patent application (OPI) No. 2,226,770, Japanese patent applications (OPI) No. 9728/1973 and 9729/1973, etc.

The present invention finds particular usage in combination with positive layers and image receiving layers for diffusion transfer elements as described in U.S. Pat. Nos. 3,635,707, 3,227,550, 3,227,551 (for example, see Column 12, lines 17 to 30 and FIG. 5) and 3,227,552, and in U.S. No. B 351,673.

The heretofore offered discussion will enable one skilled in the art to practice the invention with optimum results on a commercial or, if desired, on an experimental scale. However, considering economics and consumer preferences, certain highly preferred embodiments of the present invention exist, and these are described below. They are not to be construed as limitative on the present invention, however, merely as illustrating commercially most desirable embodiments of the invention.

| | |
|---|---|
| Thickness of layer: | |
| red sensitive silver halide emulsion layer | 1 to 10 μ |
| green sensitive silver halide emulsion layer | 1 to 10 μ |
| blue sensitive silver halide emulsion layer | 1 to 10 μ |
| intermediate layer | 1 to 3 μ |
| protective layer | 0.5 to 3 μ |
| Wt. ratio of Ag/gelatin: | 0.05 to 2.0 |
| Silver halide grain size: | 0.05 to 10 μ |
| Oil droplet size: | 0.5 to 3 μ |

The present invention will now be illustrated in greater detail by several examples, where all percentages are weight percentages unless otherwise indicated.

EXAMPLE 1

A mixture of the components shown in Table 1 below was dissolved in a mixture of 15 ml of dioctyl butyl phosphate and 30 ml of ethyl acetate by heating on a steam bath and the resultant solution was added to 100 ml of an aqueous solution containing 10 g of gelatin and 0.5 g of sodium cetylsulfate, while vigorously mechanically stirring, to prepare a dispersion of the mixture. This dispersion was mixed with 300 g of a photographic emulsion containing 1.41 ×0 $10^{-1}$ mol of silver chlorobromide (containing 50 mol% silver chloride and 50 mol% silver bromide) and 27 g of gelatin, and, after adding to the mixture 3 ml of a 4% aqueous solution of 2-hydroxy-4,6-dichloro-s-triazine sodium salt and adjusting the pH to 6.3, the resultant mixture was coated on a paper support resin-coated with polyethylene. This color paper contained, per m², 5.25 × $10^{-4}$ mol of the coupler and 4.2 × $10^{-3}$ mol of silver halide. The Ag/gelatin ratio = 0.4 (wt. ratio) and the thickness of the layer was 1.74 μ.

These color papers were subjected to step-wise exposure and processing as described below.

| | | | |
|---|---|---|---|
| Color Processing Step | | | |
| 1. Color Development | 30° C | 4 minutes | |
| 2. Blixing | " | 2 minutes | |
| 3. Water Washing | " | 2 minutes | |
| 4. Stabilizing Bath | " | 2 minutes | |
| Color Developer Solution | | (pH 10.2) | |
| Sodium Metaborate | | 25 | g |
| Sodium Sulfite | | 2 | g |
| Hydroxylamine (sulfate) | | 2 | g |
| Potassium Bromide | | 0.5 | g |
| 6-Nitrobenzimidazole (nitrate) | | 0.02 | g |
| Sodium Hydroxide | | 4 | g |
| Benzyl Alcohol | | 15.8 | ml |
| Diethylene Glycol | | 20 | ml |
| 4-(N-Ethyl-N-β-methanesulfonamidoethyl)-amino-2-methylaniline Sesquisulfate | | 8 | g |
| Water to make | | 1 | l |
| Blixing Solution | | (pH 6.9) | |
| Ferric Ethylenediaminetetraacetate | | 45 | g |
| Ammonium Thiocyanate | | 10 | g |
| Sodium Sulfite | | 10 | g |
| Ammonium Thiosulfate (60%) | | 100 | ml |
| Sodium Ethylenediaminetetraacetate | | 5 | g |
| Water to make | | 1 | l |
| Stabilizing Bath | | | |
| Tartaric Acid | | 10 | g |
| Zinc Sulfate | | 10 | g |
| Sodium Metaborate | | 20 | g |
| Water to make | | 1 | l |

The samples thus processed to have a magenta color image were exposed for four weeks to a daylight fluorescent lamp at an illuminance of about 28,000 lux through a filter substantially absorbing ultraviolet rays of wavelengths shorter than 400 mμ. The light fastness of the magenta color image in these samples is shown in Table 1 using the density reduction ratio (%) with respect to the initial density. The yellowing of the highlight portions of these samples after the exposure test measured by blue light is also indicated.

Furthermore, the reduction ratio of the maximum color density, when the coated samples were stored for three months at room temperature and then processed, is shown in Table 1.

TABLE 1

| | Composition of Dispersion in Coated Sample | | | | Four Weeks under Fluorescent Lamp | | | |
|---|---|---|---|---|---|---|---|---|
| Sample | A* | B* | C* | D | E | F | G | H |
| 1 | Cp-6 10.8 g | — | — | — | 74 | 89 | 0.24 | no change |
| 2 | " | — | — | 2,5-Di-tert-octylhydroquinone 1.0g | 71 | 84 | 0.12 | " |
| 3 | " | — | Compound 112 0.75 g | — | 71 | 82 | 0.13 | " |
| 4 | " | Compound 23 2.5 g | — | — | 22 | 35 | 0.27 | 28 |
| 5 | " | — | Compound 112 0.75 g | 2,5-Di-tert-octylhydroquinone 1.0 g | 70 | 82 | 0.12 | no change |
| 6 | " | Compound | — | " | 23 | 34 | 0.12 | " |

TABLE 1-continued

| Sample | Composition of Dispersion in Coated Sample A* | B* | C* | D | Four Weeks under Fluorescent Lamp E | F | G | H |
|---|---|---|---|---|---|---|---|---|
| | | 23 2.5 g | | | | | | |
| 7 | " | " | Compound 112 0.75 g | — | 19 | 14 | 0.27 | 26 |
| 8 | " | " | " | 2,5-Di-tert-octylhydroquinone 1.0 g | 18 | 14 | 0.11 | no change |
| 9 | Cp-1 12.4 g | — | — | — | 84 | 93 | 0.23 | no change |
| 10 | Cp-1 12.4 g | Compound 23 2.5 g | — | 2,5-Di-tert-octylhydroquinone 1.0 g | 30 | 45 | 0.12 | no change |
| 11 | " | " | Compound 112 0.75 g | " | 20 | 17 | 0.11 | " |
| 12 | Cp-24 13.7 g | — | — | 2,5-Di-tert-octylhydroquinone 1.0 g | 26 | 33 | 0.11 | " |
| 13 | " | Compound 23 2.5 g | Compound 112 0.75 g | " | 17 | 13 | 0.11 | " |
| 14 | Cp-25 13.2 g | — | — | " | 23 | 34 | 0.12 | " |
| 15 | " | — | Compound 112 0.75 g | " | 19 | 15 | 0.11 | " |
| 6' | Same as Sample 6 | Same as Sample 6 | Compound 104 Added to Stabilizing Bath | Same as Sample 6 | 19 | 15 | 0.11 | — |
| 10' | Same as Sample 10 | Same as Sample 10 | " | Same as Sample 10 | 20 | 18 | 0.11 | — |
| 14' | Same as Sample 14 | Same as Sample 14 | " | Same as Sample 14 | 19 | 14 | 0.11 | — |

*Cp and Compound Numbers refer to materials as earlier identified; hereafter the same.
A: Coupler
B: Light Fastness Improving Phenolic Agent
C: Synergistic Light Fastness Improving Agent Represented by General Formula (V)
D: Nucleus Substituted Hydroquinone
E: Density Reduction Ratio at Initial Density of 2.0 (%)
F: Density Reduction Ratio at Maximum Density (%)
G: Yellowing
H: Reduction Ratio of Maximum Color Density after Storage for Three Months(%)

As is apparent from the results shown in Table 1, when the synergistic light fastness improving agent (Compound 112) was used alone (in Sample 3), the light fastness improving effect was hardly observed, and, even when it was used together with the conventionally used hydroquinone compound (in Sample 5), substantially no improvement was observed. The level of light fastness obtained from Samples 4 and 6 were the limit of prior techniques.

On the contrary, when the light fastness improving phenolic agent (Compound 23) and the synergistic light fastness improving agent (Compound 112) were used in combination according to the present invention (in Samples 7 and 8), a substantial effect of improving light fastness which could not be expected from the individual use of these compounds was obtained in a degree far superior to the prior techniques, i.e., a superior synergy of the phenolic compound in improving light fastness of photographic pyrazolone azomethine magenta dyes was found by the inventors.

As is clear from the results for Sample 8, the additional use of the nucleus substituted hydroquinone is preferred for reducing yellowing due to light exposure and fog, and to improve the stability of the coupler during storage of the photographic light-sensitive material before development.

Further, the method of the present invention provides an extremely high light fastness improving effect to a 3-acylamino-5-pyrazolone magenta coupler, which is inferior to the 3-anilino-5-pyrazolone magenta coupler used in Samples 1 to 8 with respect to the light fastness of magenta color image formed (compare Sample 1 with Sample 9 and Sample 6 with Sample 10), as is apparent from the results in Table 1 (Sample 11). This defect of the 3-acylamino type magenta coupler can be overcome using the method of the present invention.

Since the coupler used in Samples 12 to 15 has a light fastness improving phenolic agent residue in its molecule, Samples 13 and 15 which had incorporated the synergistic light fastness improving agent show a higher light fastness of the color image in comparison with Samples 12 and 14.

The results of Samples 6', 10' and 14' in Table 1 was obtained by processing Samples 6, 10 and 14 by the above described processing procedure but using the following stabilizing bath containing the synergistic light fastness improving agent of the present invention in the stabilizing bath and not in the element and subjecting to the same fading test as described above.

| Stabilizing Bath | |
|---|---|
| Tartaric Acid | 10 g |
| Zinc Sulfate | 10 g |
| Sodium Metaborate | 20 g |
| Compound 104 | 1 g |
| Water to make | 1 l |

These results show that the same synergistic light fastness improving effect of color images was also obtained when the synergistic light fastness improving agent represented by General Formula (V) was added to a stabilizing bath in processing.

EXAMPLE 2

Onto a baryta paper resin coated with polyethylene were coated, as a first layer, a blue sensitive silver chlorobromide emulsion containing α-pivaloyl-α-(2,4-dioxo-5,5-dimethyloxazolidin-3-yl)-2-chloro-5-[α-(2,4-di-tert-amylphenoxy)butyramido]acetanilide in a dry thickness of 3.0 microns (coupler coated amount: 8.10 × $10^{-4}$ mol/m$^2$; silver coated amount: 3.24 × $10^{-3}$ mol/m$^2$; silver bromide: 70 mol%; silver chloride: 30 mol%) and, further, as a second layer, a gelatin layer containing 2-tert-dodecylhydroquinone in a dry thickness of 1.5 microns (hydroquinone coated amount: 0.05 g/m$^2$).

A mixture of 10.8 g of coupler (Cp-6), 1.2 g of the light fastness improving phenolic agent (Compound 27), 1.0 g of the synergistic light fastness improving agent (Compound 113) and 0.9 g of 2,5-di-tert-octylhydroquinone was dissolved by heating in a mixture of 14 ml of tricresyl phosphate and 30 ml of ethyl acetate and the resultant solution was added to 100 ml of an aqueous solution containing 10 g of gelatin and 0.5 g of sodium dodecylbenzenesulfonate, while being stirred using a homogenizer, to prepare a dispersion. This dispersion was mixed with 300 g of a green sensitive photographic emulsion having the same composition as Example 1 and the mixture was coated in a dry thickness of 2.8 microns as a third layer (coated coupler amount: 4.12 × $10^{-4}$ mol/m$^2$; silver coated amount: 1.65 × $10^{-3}$ mol/m$^2$).

A gelatin layer containing 2,5-di-tert-octylhydroquinone and as an ultraviolet absorbant, 2-(5-chlorobenzotriazol-2-yl)-4-methyl-6-tert-butylphenol and 2-(benzotriazol-2-yl)-4-tert-butylphenol was then coated thereon in a dry thickness of 2.5 microns as a fourth layer (hydroquinone coated amount: 0.05 g/m$^2$; benzotriazole coated amount: 0.4 g/m$^2$, each), whereafter a red sensitive emulsion containing 2-[α-(2,4-di-tert-amylphenoxy)butyramido]-4,6-dichloro-5-methylphenol was coated in a dry thickness of 2.5 microns as a fifth layer (coupler coated amount: 0.98 × $10^{-3}$ mol/m$^2$; silver coated amount: 2.94 × $10^{-3}$ mol/m$^2$; silver bromide: 50 mol%; silver chloride: 50 mol%) and gelatin was then coated in a dry thickness of 1.0 micron as an uppermost layer, thus preparing a color print paper (Sample 16).

For comparison, another color print paper was prepared in the same manner as described above but excluding the synergistic light fastness improving agent (Compound 113) from the third layer of Sample 16 (Sample 17).

The thickness, etc., of the various layers in this example was as follows:

blue sensitive layer: 3.0 μ; Ag/gelatin = 0.2 (wt. ratio)
intermediate layer: 1.5 μ
green sensitive layer: 2.8 μ; Ag/gelatin = 0.37 (wt. ratio)
intermediate layer: 2.5 μ
red sensitive layer: 2.5 μ; Ag/gelatin = 0.4 (wt. ratio)
protective layer: 1.0 μ

These color print papers were step-wise exposed with red, green and blue light separately and then subjected to processing the same as described in Example 1. The samples were then subjected to the light fading test under a day light fluorescent lamp at an illuminance of about 28,000 lux earlier described. The density reduction ratio (%) with respect to the initial density is shown in the following table.

| | Magenta Color Image | | Yellow Color Image | | Cyan Color Image | |
|---|---|---|---|---|---|---|
| | Initial Density | | Initial Density | | Initial Density | |
| | 2.0 | 1.0 | 2.0 | 1.0 | 2.0 | 1.0 |
| Sample 16 | 12 | 18 | 14 | 22 | 5 | 7 |
| Sample 17 | 22 | 30 | 14 | 22 | 5 | 7 |

According to the method of the present invention, the light fastness of magenta color image is improved so as to balance the light fastness of the yellow and cyan color images and thus a color paper providing superior light fastness is obtained.

EXAMPLE 3

On a paper support laminated with polyethylene the following layers were coated.

First Layer: Blue Sensitive Emulsion Layer
Silver: 178 mg/m$^2$
Gelatin: 1.36 g/m$^2$
Coupler: α-Pivaloyl-α-(2,4-di-oxo-5,5-dimethylhydantoin-3-yl)-2-chloro-5-[α-(2,4-di-tert-amylphenoxy)butyramido]acetanilide: 510 mg/m$^2$
Second Layer: Gelatin Intermediate Layer
Gelatin: 1.10 g/m$^2$
Di-tert-octylhydroquinone: 56 mg/m$^2$
Third Layer: Green Sensitive Silver Halide Emulsion Layer having the same composition as that of Example 2
Silver: 110 mg/m$^2$
Gelatin: 1.47 g/m$^2$
Tricresyl Phosphate: 250 mg/m$^2$
Coupler: Cp-6: 219 mg/m$^2$
Light Fastness Improving Phenolic Compound: Compound 27: 25 mg/m$^2$
Synergistic Light Fastness Improving Compound: Compound 112: 15 mg/m$^2$
2,5-Di-tert-octylhydroquinone: 20 mg/m$^2$
By a method similar to that used for Sample 8 in Example 1 the dispersion was prepared and it was mixed with the emulsion and coated.
Fourth Layer: Ultraviolet Absorbing Filter Layer
Gelatin: 1.78 g/m$^2$
Di-tert-octylhydroquinone: 50 mg/m$^2$
Ultraviolet Absorbing Agent: The same ultraviolet absorbing agents as were used in the fourth layer of Example 2: 2.5 g/m$^2$ *each*
Fifth Layer: Red Sensitive Silver Halide Emulsion Layer
Silver: 67 mg/m$^2$
Gelatin: 1.00 g/m$^2$
Coupler: 2-[α-(2,4-Di-tert-amylphenoxy)-butyramido]-4,6-dichloro-t-methylphenol: 389 mg/m$^2$
Ultraviolet Absorbing Agent: 2-(2'-Hydroxy-3'-tert-butyl-5'-methylphenyl)-5-chlorobenzotriazole: 50 mg/m$^2$ and 2-(2'-hydroxy-3',5'-di-tert-butylphenyl)benzotriazole: 40 mg/m$^2$
Sixth Layer: Gelatin Protective Layer
Gelatin: 1.1 g/m$^2$ The thickness, etc., of the various layers in this Example was as follows:

blue sensitive layer: 2.45 μ; Ag/gelatin = 0.13 (wt. ratio)
Intermediate layer: 1.5 μ
green sensitive layer: 2.35 μ; Ag/gelatin=0.075 (wt. ratio)

intermediate layer: 2.0 μ
red sensitive layer: 2.0 μ; Ag/gelatin=0.067 (wt. ratio)
protective layer: 1.0 μ

The color paper thus prepared was step-wise exposed with red, green and blue light separately and subjected to processing as follows:

| Processing Step | | |
|---|---|---|
| Development | 31° C | 1 minute |
| Intensification | " | 1 minute |
| Water Washing | " | 1 minute |
| Blixing | " | 2 minutes |
| Water Washing | " | 1 minute |
| Stabilizing | " | 30 seconds |
| **Developer Solution** | | |
| Sodium Tetrapolyphosphate | | 2.0 g |
| Benzyl Alcohol | | 15 ml |
| Sodium Sulfite | | 2 g |
| Hydroxylamine (sulfate) | | 2 g |
| Potassium Bromide | | 0.5 g |
| 4-Amino-N-ethyl-N-(β-methanesulfonamido-ethyl)-m-toluidine Sesquisulfate (monohydrate) | | 8 g |
| Water to make | | 1 l |
| **Intensification Solution** | | |
| Sodium Chlorite | | 40 g |
| Sodium Carbonate | | 10 g |
| Water to make | | 1 l |
| **Blixing Solution** | | |
| Ammonium Thiosulfate (70%) | | 150 ml |
| Sodium Sulfite | | 5 g |
| Na[Fe(EDTA)]* | | 40 g |
| EDTA** | | 4 g |
| Water to make | | 1 l |
| **Stabilizing Solution** | | |
| Glacial Acetic Acid | | 10 ml |
| Sodium Acetate | | 5 g |
| Formaldehyde (37%) | | 5 ml |
| Water to make | | 1 l |

*Sodium ferric ethylenediamine tetraacetic acid
**Ethylene diamine tetraacetic acid Further, another color paper of this example was exposed in the same manner and subjected to the following processing.

| Processing Step | | |
|---|---|---|
| Development | 40° C | 60 seconds |
| Intensification | " | 90 seconds |
| Blixing | " | 60 seconds |
| Water Washing | 26° C | 90 seconds |
| **Color Developer Solution** | | (ph 10.08) |
| Benzyl Alcohol | | 15.0 ml |
| $K_2Co_3$ | | 30.0 g |
| KBr | | 0.5 g |
| Hydroxylamine (sulfate) | | 2.0 g |
| $K_2So_3$ | | 4.0 g |
| Diaminopropanoltetraacetic Acid | | 3.0 g |
| N-Ethyl-N-methoxyethyl-3-methyl-p-phenylenediamine di-p-toluene sulfonate | | 7.5 g |
| Water to make | | 1 l |
| **Intensification Bath** | | (pH 10.1) |
| Benzyl Alcohol | | 15.0 ml |
| $K_2Co_3$ | | 7.5 g |
| KBr | | 2.0 g |
| $K_2So_3$ | | 2.0 g |
| Diaminopropanoltetraacetic Acid | | 10.0 g |
| $[Co(NH_3)_6]Cl_3$ | | 10.0 g |
| Water to make | | 1 l |
| **Blixing Bath** | | (pH 4.5) |
| Diaminopropanoltetraacetic Acid | | 3.0 g |
| Acetic Acid | | 20.0 ml |
| $(NH_4)_2S_2O_3$ (60% aqueous solution) | | 150.0 ml |
| $Na_2So_3$ | | 15.0 g |
| $[Co(NH_3)_6]Cl_3$ | | 8.0 g |
| Water to make | | 1 l |

The magenta color images obtained by these two processing steps both had extremely good light fastness and were balanced with the level of light fastness of the cyan color images and the yellow color images.

EXAMPLE 4

Onto a cellulose triacetate support having a thickness of 130 microns the following layers were coated.

Sample A

First Layer: a layer containing $2.5 \times 10^{-3}$ mol/m² of a diffusible magenta dye forming coupler (Cp-28), 0.7 g of N,N-diethyl laurylamide, $1.1 \times 10^{-2}$ mol/m² of silver halide and 2.0 g/m² of gelatin.
Second Layer: a layer containing 1.3 g/m² of gelatin.

The film was subjected to exposure and brought into contact with a dye image receiving film which comprised a paper support coated with polyethylene on both surfaces having thereon a layer containing 3.5 g/m² of poly-4-vinyl pyridine (M.W. = about 100,000), 1.5 g/m² of poly(2-methacrylethyltrimethylammonium-methylsulfate) (M.W. = about 250,000), 8.0 g/m² of polyvinyl alcohol (M.W. = about 40,000), 0.15 g/m² of Compound 27, 0.2 g/m² of tricresyl phosphate and 0.05 g/m² of Compound 118, which was hardened with formaldehyde, and a viscous processing solution having the following composition was spread therebetween in a conventional amount to transfer a magenta color image to the image receiving layer.

The thickness, etc., of various layers in this example was as follows:

Sample A:

First Layer: 3.2 μ; Ag/gelatin = 1.05 (wt. ratio)
Protective Layer: 1.3 μ

| Viscous Processing Solution | | |
|---|---|---|
| Ascorbic Acid | 0.2 | g |
| 3-Methyl-4-amino-N-ethyl-N-(β-hydroxyethyl) aniline Sulfate | 30.0 | g |
| Potassium Bromide | 1.4 | g |
| Trisodium Phosphate (12 hydrate) | 20.0 | g |
| Sodium Hydroxide | 40.0 | g |
| Hydroxyethyl Cellulose | 30.0 | g |
| Water (viscosity: 30,000 cps at 25° C) | 880 | ml |

Sample B

A magenta color image was obtained on an image receiving film by the same procedure as described above but excluding Compound 118 from the image receiving film of Sample A.

Sample A and Sample B were exposed to a xenon arc lamp and the light fastness of the magenta color images was measured. It was found that Sample A had a better light fastness than Sample B.

While the invention has been described in detail and with reference to specific embodiments thereof, it will be apparent to one skilled in the art that various changes and modifications can be made therein without departing from the spirit and scope thereof.

What is claimed is:

1. A method for improving the light fastness of a magenta color image in a silver halide color photograph which comprises incorporating into a layer containing a magenta color image, which is formed upon reaction of a magenta coupler and an oxidation product of an aromatic primary amine color developing agent, at least one light fastness improving phenolic compound selected from the group consisting of a phenol derivative in which at least one of the ortho positions to the hydroxy group thereof is substituted with a tertiary alkyl group, a bisphenol derivative, a phosphoric acid ester of a phenol derivative, a halophenol or a phenol derivative in which the para position to the hydroxy group is substituted with an oxygen atom and a 5- or 6-membered ring formed together with the oxygen atom is fused to the phenol nucleus of the phenol derivative and at least one synergistic light fastness improving agent selected from a sulfide or sulfoxide compound represented by the following General Formula (V):

$$X—B—Y \qquad (V)$$

wherein B represents —S— or —SO—; X and Y, which may be the same or different, each represents $—(CH_2)_n—R_1$,

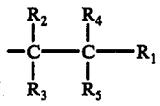

or

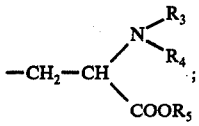

$R_1$ represents $—COOR_3$,

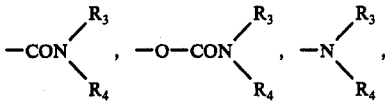

$—OR_6$, $—O—COR_6$, $—NHSO_2R_6$,

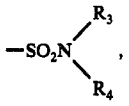

$—NHCOR_6$, a cyano group, an aryl group or a hydroxy group; $R_2$ represents an alkyl group of 1 to 30 carbon atoms, an aryl group, an aralkyl group, a hydroxy group, a cyano group or $—COOR_3$; $R_3$, $R_4$, $R_5$ and $R_6$ each represents a hydrogen atom, an alkyl group of 1 to 30 carbon atoms, an aryl group or an aralkyl group with the proviso that $R_6$ is not a hydrogen atom; and $n$ is an integer of 1 to 4.

2. A method for improving the light fastness of a magenta color image which comprises incorporating into a layer containing a magenta color image which is formed using a color intensification bath in a processing step of a color photographic material which comprises a support having thereon at least one silve halide emulsion layer containing a diffusion resistant magenta coupler, at least one light fastness inproving phenolic compound selected from the group consisting of a phenol derivative in which at least one of the ortho positions to the hydroxy group thereof is substituted with a tertiary alkyl group, a bisphenol derivative, a phosphoric acid ester of a phenol derivative, halophenol or a phenol derivative in which the para position to the hydroxy group is substituted with an oxygen atom and a 5- or 6-membered ring formed together with the oxygen atom is fused to the phenol nucleus of the phenol derivative and at least one synergistic light fastness improving agent selected from the compounds represented by General Formula (V):

$$X—B—Y \qquad (V)$$

wherein B represents —S— or —SO—; X and Y, which may be the same or different, each represents $—(CH_2)_n—R_1$,

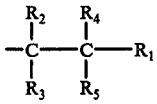

or

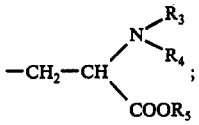

$R_1$ represents $—COOR_3$,

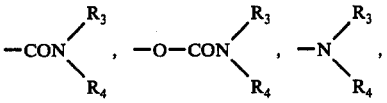

$—OR_6$, $—O—COR_6$, $—NHSO_2R_6$,

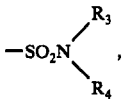

$—NHCOR_6$, a cyano group, an aryl group or a hydroxy group; $R_2$ represents an alkyl group of 1 to 30 carbon atoms, an aryl group, an aralkyl group, a hydroxy group, a cyano group or $—COOR_3$; $R_3$, $R_4$, $R_5$ and $R_6$ each represents a hydrogen atom, an alkyl group of 1 to 30 carbon atoms, an aryl group or an aralkyl group, with the proviso that $R_6$ is not a hydrogen atom; and $n$ is an integer of 1 to 4.

3. A silver halide color photographic material which comprises incorporating into at least one layer forming a magenta color image upon reaction of a non-diffusible magenta coupler and an oxidation product of an aromatic primary amine color developing agent, at least one light fastness improving phenolic compound selected from the group consisting of phenol derivatives in which at least one of the positions ortho to the hydroxy group thereof is substituted with a tertiary alkyl group, bisphenol derivatives, phosphoric acid esters of a phenol derivative, polycyclic phenol derivatives, phenol derivative in which the position para to the hydroxy group is substituted with an oxygen atom and a 5- or 6-membered ring formed together with the oxygen atom is fused to the phenol nucleus, and at least one synergistic light fastness improving agent selected from sulfide or sulfoxide compounds represented by the following General Formula (V);

$$X — B — Y \qquad (V)$$

wherein B represents —S— or —SO—; X and Y, which may be the same or different, each represents $—(CH_2)_n—R_1$,

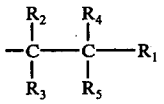

or

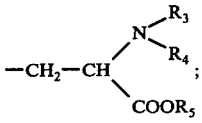

$R_1$ represents $—COOR_3$,

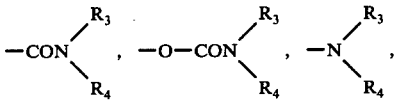

$—OR_6$, $—O—COR_6$, $—NHSO_2R_6$,

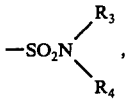

$—NHCOR_6$, a cyano group, an aryl group or a hydroxy group, $R_2$ represents an alkyl group of 1 to 30 carbon atoms, an aryl group, an aralkyl group, a hydroxy group, a cyano group or $—COOR_3$; $R_3$, $R_4$, $R_5$ and $R_6$ each represents a hydrogen atom, an alkyl group of 1 to 30 carbon atoms, an aryl group or an aralkyl group, with the proviso that $R_6$ is not a hydrogen atom; and $n$ is an integer of 1 to 4.

4. The silver halide color photographic material of claim 3, wherein the magenta coupler is represented by General formulae (I) or (II):

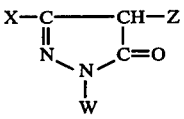

(I)

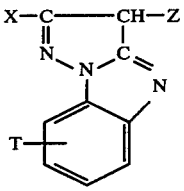

(II)

wherein W represents a hydrogen atom or a group with 1 to 35 carbon atoms, which groups can be substituted with a substituent selected from a halogen atom or a nitro, cyano, aryl, alkoxy, aryloxy, carboxy, alkylcarbonyl, arylcarbonyl, alkoxycarbonyl, aryloxycarbonyl, sulfo, acyloxy, sulfamoyl, carbamoyl, acylamino, imido, ureido, thioureido, urethane, thiourethane, sulfonamido, heterocyclic, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, hydroxy and mercapto group; or W represents an aryl group, and an aryl group having one or more substituents selected from a halogen atom or an alkyl, alkenyl, cycloalkyl, aralkyl, cycloalkenyl, nitro, cyano, aryl, alkoxy, aryloxy, carboxy, alkylcarbonyl, arylcarbonyl, alkoxycarbonyl, aryloxycarbonyl, sulfo, acyloxy, sulfamoyl, carbamoyl, acylamino, imido, ureido, thioureido, urethane, thiourethane, sulfonamido, heterocyclic, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-alkylanilino, N-arylanilino, N-acylanilino, hydroxy and mercapto group or W represents a heterocyclic group or a substituted heterocyclic group with one or more substituents above described for the aryl group, or W represents an acyl, thioacyl, alkylsulfonyl, arylsulfonyl, alkylsulfinyl, arylsulfinyl, carbamoyl, or thiocarbamoyl group; X represents a hydrogen atom or a group having 1 to 35 carbon atoms, which groups can have one or more substituents above described for W; further, X represents an aryl group or a heterocyclic group which can be substituted with the one or more substituents as described for W; furthermore, X represents an alkoxycarbonyl group, an aryloxycarbonyl group, an aralkyloxycarbonyl group, an alkoxy group, an aryloxy group, an alkylthio group, an arylthio group, a carboxy group, an acylamino group, an imido group, an N-alkylacylamino group, an N-arylacylamino group, a ureido group, a thioureido group, a urethane group, a thiourethane group, an anilino group, an alkylamino group, a cycloamino group, an alkylcarbonyl group, an arylcarbonyl group, a sulfonamido group, a carbamoyl group, a sulfamoyl group, a guanidino group, a cyano group, an acyloxy group, a sulfonyloxy group, a hydroxy, a mercapto group, a halogen atom or a sulfo group; T represents a hydrogen atom or a group having 1 to 35 carbon atoms, which can be substituted with the one or more substituents as descrobed for W; further, T represents an aryl group or a heterocyclic group which can be substituted with one or more substituents as described for W; or T can represent a halogen atom, a cyano, alkoxy, aryloxy, carboxy, alkoxycarbonyl, arylcarbonyl, acyloxy, alkylcarbonyl, arylcarbonyl, alkylthiocarbonyl, arylthiocarbonyl, sulfo, sulfamoyl, carbamoyl, acylamino, imido, ureido, thioureido, urethane, thiourethane, sulfonamido, alkylsulfonyloxy, arylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, hydroxy or a mercapto group; Z represents a hydrogen atom or a group which is directly bonded to the coupling position and is capable of being released upon the coupling reaction with the oxidation product of an aromatic primary amine developing agent.

5. The silver halide color photographic material of claim 4, wherein the light fastness improving phenolic compound is a compound represented by General Formula (III):

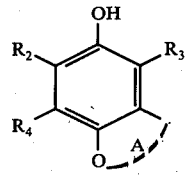

(III)

wherein $R_2$, $R_3$ and $R_4$, which may be the same or different, each represents a hydrogen atom, an alkyl group, a cycloalkyl group, an alkoxy group, an aryl group, an aryloxy group, an aralkyl group, an aralkoxy group, an alkenyl group, an alkenoxy group, an acylamino group, a halogen atom, an alkylthio group, an imido group, an acyl group, a sulfonamido group, an alkylamino group, an alkoxycarbonyl group or an acyloxy group; and A represents the non-metallic atoms necessary to form a 5-membered or 6-membered ring containing a —C=λ C—O— moiety, which ring can substituted with an alkyl group, an alkoxy group, an aryl group, an aryloxy group, an aralkyl group, an aralkoxy group, an alkenyl group, an alkenoxy group, an N-substituted amino group, or a heterocyclic group.

6. The silver halide color photographic material of claim 4, wherein the light fastness improving phenolic compound is a 6-hydroxychroman derivative, a 5-hydroxycoumaran derivative, a hexahydrodibenzofuran-5-ol derivative or a 6,6'-dihydroxy-bis-2,2'-spirochroman derivative.

7. The silver halide color photographic material of claim 4, wherein the light fastness improving phenolic compound is a compound represented by General Formula (IV):

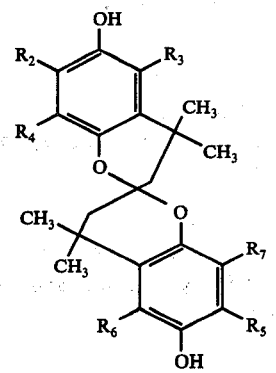

(IV)

wherein $R_2$, $R_3$, $R_4$, $R_5$, $R_6$ and $R_7$ can be the same or different, and each represents a hydrogen atom, an alkyl group, a cycloalkyl group, an alkoxy group, an aryl group, an aryloxy group, an aralkyl group, an aralkoxy group, an alkenyl group, an alkenoxy group, an acylamino group, a halogen atom, an alkylthio group, an imido group, an acyl group, a sulfonamido group, an alkylamino group, an alkoxycarbonyl group or an acyloxy group.

8. The silver halide color photographic material of claim 4, wherein the magenta coupler is a 3-anilino-5-pyrazolone derivative or a 3-acylamino-5-pyrazolone derivative.

9. The silver halide color photographic material of claim 4, wherein the synergistic light fastness improving agent is a compound in which X and Y of General Formula (V) are the same.

10. The silver halide color photographic material of claim 9, wherein the synergistic light fastness improving compound is a compound of General Formula (V) in which X is

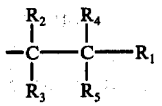

11. The silver halide color photographic material of claim 9, wherein the synergistic light fastness improving compound is a compound of General Formula (V) in which X is $-(CH_2)_n-R_1$.

12. The silver halide color photographic material of claim 4, wherein the synergistic light fastness improving compound is at least one selected from the group consisting of:

Compound 101

Bis-β-phenylethylsulfide,

Compound 102

Bis-β-n-octyloxycarbonylethylsulfide,

Compound 103

Bis-β-dimethylaminoethylsulfide,

Compound 104

Bis-β-hydroxyethylsulfide,

Compound 105

Bis-β-amino-β-carboxyethylsulfide,

Compound 106

Bis-α-methyl-β-n-dodecyloxycarbonylethylsulfide,

Compound 107

Bis-β-methyl-β-n-octadecyloxycarbonylethylsulfide,

Compound 108

Bis-β-ethoxycarbonylbutylsulfide, and

Compound 109

Bis-β-methylcarbonyloxyethylsulfide.

13. The silver halide color photographic material of claim 12, wherein the synergistic light fastness improving compound is selected from the group consisting of:

Compound 101

Bis-β-phenylethylsulfide,

Compound 112

Bis-β-n-dodecyloxycarbonylethylsulfide,

Compound 113

Bis-β-n-octadecyloxycarbonylethylsulfide, and

Compound 118

Bis-(β,β-dimethyl-β-n-octyloxycarbonylethyl)sulfide.

14. The silver halide color photographic material of claim 3, wherein the magenta coupler is a non-diffusible magenta coupler having a hydrophobic residue of 8 to 32 carbon atoms.

15. The silver halide color photographic material of claim 4, wherein the magenta coupler is at least one selected from the group consisting of:

Cp-1

1-(2,4,6-Trichlorophenyl)-3-{3-[α-(2,4-di-tert-amylphenoxy)butyramido]benzamido}-5-oxo-2-pyrazoline, Cp-2

1-(2,4,6-Trichlorophenyl)-3-[3-(α-ethoxycarbonyloctadecanamido)benzamido]-5-oxo-2-pyrazoline, Cp-3

1-(2,4-Dimethyl-6-chlorophenyl)-3-{3-[(2,4-di-tert-amylphenoxy)acetamido]benzamido}-5-oxo-2-pyrazoline, Cp-4

1-(2,4,6-Trichlorophenyl)-3-{3-[(2,4-di-tert-amylphenoxy)acetamido]benzamido}-5-oxo-2-pyrazoline-4-yl-benzylcarbonate, Cp-5

1-[4-(4-tert-amylphenoxy)phenyl]-3-[α-(4-tert-amylphenoxy)propionamido]-5-oxo-2-pyrazoline, Cp-6

1-(2,4,6-Trichlorophenyl)-3-(2-chloro-5-tetradecanamido)anilino-5-oxo-2-pyrazoline, Cp-7

1-(2,6-Dichloro-4-methoxyphenyl)-3-{2-chloro-5-[α-(2,4-di-tert-amylphenoxy)butyramido]anilino}-4-phenylthio-5-oxo-2-pyrazoline, Cp-8

1-(2,6-Dichloro-4-methoxyphenyl)-3-{3-[α-(3-n-pentadecylphenoxy)butyramido]benzamido}-5-oxo-2-pyrazoline, Cp-9

1-(2,4-Dimethyl-6-chlorophenyl)-3-{3-[β-dodecyloxycarbonyl)propionamido]benzamido}-5-oxo-2-pyrazoline, Cp-10

1-(2,4,6-Trichlorophenyl)-3-{2-chloro-5-[α-(4-methoxyphenoxy)tetradecanamido]anilino}-5-oxo-2-pyrazoline, Cp-11

1-(2,4,6-Trichlorophenyl)-3-{3-[α-(2,4-di-tert-amylphenoxy)butyramido]benzamido-4-imidazolyl}-5-oxo-2-pyrazoline, Cp-12

1-(2,4,6-Trichlorophenyl)-3-{2-chloro-5-[α-(3,5-di-tert-butyl-4-hydroxyphenoxy)tetradecanamido]anilino}-5-oxo-2-pyrazoline, Cp-13

1-(2,6-Dichloro-4-methylphenyl)-3-{3-[(3-n-pentadecylphenoxy)acetamido]benzamido}-5-oxo-2-pyrazoline, Cp-14

1-(2,4,6-Trichlorophenyl)-3-{γ-[2-hydroxy-3-(2-benzotriazolyl)-5-n-pentylphenyl]butyramido}-5-oxo-2-pyrazoline, Cp-15

1-(2,4,6-Trichlorophenyl)-3-{2-chloro-5-[β-dodecyloxycarbonyl)ethylcarbonyl]anilino}-5-oxo-2-pyrazoline, Cp-16

1-(2,4,6-Trichlorophenyl)-3-[3-(dodecylureido)benzamido]-5-oxo-2-pyrazoline,

Cp-17

1-(2,4,6-Trichlorophenyl)-3-[α-(2,4-di-tert-amylphenoxy)butyramido]-4-pentafluorobenzamido-5-oxo-2-pyrazoline, Cp-18

1-(2,6-Dichloro-4-tetradecyloxycarbonylphenyl)-3-(2-chloro-5-methoxycarbonylanilino)-5-oxo-2-pyrazoline, Cp-19

1-(2,4,6-Trichlorophenyl)-3-(α-carboxymethyl-n-2-eicosenamido)benzamido-5-oxo-2-pyrazoline, Cp-20

1-{4-[(2,4-Di-tert-amylphenoxy)acetamido]phenyl}-3-(3-acetamido-benzamido)-5-oxo-2-pyrazoline, Cp-21

1-(2,4,6-Trichlorophenyl)-3-{3-[(2-tetradecyl-4-chlorophenoxy)acetamido]benzamido}-5-oxo-2-pyrazoline, Cp-22

1-(2,4-Dimethyl-6-chlorophenyl)-3-{3-[α-(2,4-di-tert-amylphenoxy)butyramido]phenylureido}-5-oxo-2-pyrazoline, Cp-23

1-(2,4,6-Trichlorophenyl)-3-{3-[α-(2,4-di-tert-amylphenoxy)butyramido]benzamido}-4-phenylsulfonamido-5-oxo-2-pyrazoline, Cp-24

1-(2,4,6-Trichlorophenyl)-3-{2-chloro-5-[α-(3-tert-butyl-4-hydroxyphenoxy)tetradecanamido]anilino}-5-oxo-2-pyrazoline, Cp-25

1-(2,4,6-Trichlorophenyl)-3-{2-chloro-5-[β-(2,2-dimethyl-6-hydroxy-7-tert-octyl-4-chromanyl)propionamido]anilino}-5-oxo-2-pyrazoline, Cp-26

2-{3-[α-(2,4-Di-tert-amylphenoxy)butyramido]benzamido}-7-chloropyrazolo-[1,5a]benzimidazole, Cp-27

1-(2,4,6-Trichlorophenyl)-3-{[2-chloro-5-(3,5-di-carboxyphenoxy-acetamido)]anilino}-4-[(4-N-methyl-N-octadecylsulfamoyl)phenoxy]-5-oxo-2-pyrazoline, Cp-28

1-(2-Methylphenyl)-3-(3,5-dicarboxyanilino)-4-(3-octadecylcarbamoylphenylthio)-5-oxo-2-pyrazoline, Cp-29

1-(2,6-Dichloro-4-methoxycarbonylphenyl)-3-{3-[α-(3-pentadecylphenoxy)butyramido]benzamido}-5-oxo-2-pyrazoline, Cp-30

1-(2,4,6-Trichlorophenyl)-3-{3-[(2,4-di-tert-amylphenoxy)acetamido]benzamido}-4-(4-methoxyphenylazo)-5-oxo-2-pyrazoline, Cp-31

1-(2,4,6-Trichlorophenyl)-3-(2-chloro-5-tetradecanamidoanilino)-4-(3-methyl-4-hydroxyphenylazo)-5-oxo-2-pyrazoline, and Cp-32

1-(2,4,6-Trichlorophenyl)-3-{2-chloro-5-[3-(2-dodecylcarbamoylethylthio)propanamido]anilino}-5-oxo-2-pyrazoline.

16. The silver halide color photographic material of claim 15, wherein the magenta coupler is selected from the group consisting of:

Cp-1

1-(2,4,6-Trichlorophenyl)-3-{3-[α-(2,4-di-tert-amylphenoxy)butyramido]benzamido}-5-oxo-2-pyrazoline, Cp-6

1-(2,4,6-Trichlorophenyl)-3-(2-chloro-5-tetradecanamido)anilino-5-oxo-2-pyrazoline, Cp-24

1-(2,4,6-Trichlorophenyl)-3-{2-chloro-5-[α-(3-tert-butyl-4-hydroxyphenoxy)tetradecanamido]anilino}-5-oxo-2-pyrazoline, Cp-25

1-(2,4,6-Trichlorophenyl)-3-{2-chloro-5-[β-(2,2-dimethyl-6-hydroxy-7-tert-octyl-4-chromanyl)propionamido]anilino}-5-oxo-2-pyrazoline, and Cp-28

1-(2-Methylphenyl)-3-(3,5-dicarboxyanilino)-4-(3-octadecylcarbamoylphenylthio)-5-oxo-2-pyrazoline.

17. The silver halide color photographic material of claim 4, wherein the light fastness improving phenolic compound is at least one selected from the group consisting of compounds 1 through compound 44:

Compound 1

4-(4-Methoxyphenylthio)phenol,

Compound 2

Ethyl gallate,

Compound 3

2,2'-Dihydroxy-5,5'-dimethyldiphenylsulfoxide,

Compound 4

3,3'-Di-(tert-butyl)-2,2'-dihydroxy-5,5'-dimethyldiphenyldisulfide,

Compound 5

3,3'-Di-(tert-butyl)-2,2'-dihydroxy-5,5'-dimethyldiphenylsulfone,

Compound 6

2,2'-Cyclohexylidenebis-(6-tert-butyl-4-methylphenol),

Compound 7

2,6-Bis-(3-tert-butyl-2-hydroxy-5-methylbenzyl)-4-methylphenol,

Compound 8

2,6-Di-tert-butyl-4-(β-n-octyloxycarbonylethylthiomethyl)phenol,

Compound 9

2-Tert-butyl-4-octyloxyphenol,

Compound 10

1,4-Bis-[3-(3,5-di-tert-butyl-4-hydroxyphenyl)propionyloxy]butane,

Compound 11

Octadecyl (3,5-di-tert-butyl-4-hydroxyphenyl)propionate,

Compound 12

4-{[4,6-Bis-(ethylthio)-s-triazin-2-yl]amino}-2,6-di-tert-butylphenol,

Compound 13

Tris-(3,5-di-tert-butyl-4-hydroxyphenyl)phosphate,

Compound 14

2,2'-Isopropylidenebis-(6-tert-butyl-4-methylphenol),

Compound 15

4,4'-Benzylidenebis-(2,6-di-tert-butylphenol),

Compound 16

4,4'-Ethylidenebis-(2-n-octyl-5-methylphenol),

Compound 17

2,6-Di-tert-butyl-4-methylphenol,

Compound 18

4,4'-Bis-(2-tert-amyl-5-methylphenol),

Compound 19

Tetrakis-[3-(4-hydroxy-3,5-di-tert-butyl)phenylpropionylmethyl]urethane,

Compound 20

2,2'-Methylenebis-(5-tert-butyl-4-methoxyphenol),

Compound 21

2,2'-Isobutylidenebis-(4-methoxyphenol),

Compound 22

2,6-Di-tert-butyl-α-dimethylamino-p-cresol,

Compound 23

2,2-Dimethyl-4-methyl-6-hydroxy-7-tert-octylchroman,

Compound 24

2-Methyl-2-n-octyl-6-hydroxy-7-tert-butylchroman,

Compound 25

2,2-Dimethyl-4-isopropyl-5-methyl-6-hydroxy-7-methoxychroman,

Compound 26

2-Methyl-2-n-octyl-4-[δ-(N-methylcarbamoyl)butyl]-6-hydroxy-7-tert-butylchroman, Compound 27

4,4,4',4'-Tetramethyl-6,6'-dihydroxy-7,7'-dimethyl-bis-2,2'-spirochroman,

Compound 28

2-(N-Butylanilino)-3-methyl-5-hydroxy-6-tert-octyl-coumaran,

Compound 29

2-Morpholino-3,3-dimethyl-5-hydroxy-6-tert-butyl-coumaran,

Compound 30

2,2-(β,β-Dimethyl)pentamethylene-7-cyclohexyl-6-hydroxychroman,

Compound 31

5a,6,7,7,9,9a-Hexahydro-5a-isopropyl-8-methyl-3-tert-octyl-5-dibenzofuranol,

Compound 32

2,2-(β-Isopropyl)tetramethylene-7-tert-octyl-6-hydroxychroman,

Compound 33

2-(N'-Ethoxycarbonyl-N-piperazino)-3,3-dimethyl-6-tert-butyl-5-hydroxycoumaran,

Compound 34

4,4,4',4'-Tetramethyl-6,6'-dihydroxy-7,7'-di-tert-octyl-bis-2,2'-spirochroman,

Compound 35

4,4,4',4'-Tetramethyl-6,6'-dihydroxy-7,7'-diphenyl-bis-2,2'-spirochroman,

Compound 36

2,2'-Dimethyl-6-hydroxy-7-n-dodecylthiochroman,

Compound 37

2,2-(β,β-Dimethyl)pentamethylene-7-tert-butyl-8-methyl-6-hydroxychroman,

Compound 38

2,2-Dimethyl-4-(ω-chlorononyl)-6-hydroxy-7-tert-butylchroman,

Compound 39

α-Tocopherol,

Compound 40

2-Tert-octyl-4,5-dimethylenedihydroxyphenol,

Compound 41

2-n-Dodecyl-4,5-trimethylenedihydroxyphenol,

Compound 42

2,2-Dimethyl-4-isopropyl-5,7-di-tert-butyl-6-hydroxychroman,

Compound 43

6,6'-Dihydroxy-4,4,4',4',5,5',7,7'-octamethyl-bis-2,2'-spirochroman, and

Compound 44

6,6'-Dihydroxy-4,4,4',4'-tetramethyl-5,5',7,7'-tetra-tert-butyl-bis-2,2'-spirochroman.

18. The silver halide color photograhic material of claim 17, wherein the light fastness improving phenolic compound is compound 23:

Compound 23

2,2-Dimethyl-4-methyl-6-hydroxy-7-tert-octylchroman.

19. The silver halide color photograhic material of claim 17, wherein the light fastness improving phenolic compound is compound 27:

Compound 27

4,4,4',4'-Tetramethyl-6,6'-dihydroxy-7,7'-dimethyl-bis-2,2'-spirochroman.

20. The silver halide color photographic material of claim 3, which comprises a support having thereon a blue-sensitive silver halide emulsion layer containing an α-pivaloylacetanilide type yellow coupler, a green-sensitive silver halide emulsion layer and a red-sensitive silver halide emulsion layer containing a phenol type cyan coupler, wherein the layer is said green-sensitive silver halide emulsion layer.

21. The silver halide color photographic material of claim 3, wherein the amount of the light fastness improving phenolic compound is about 0.01 mols to about 10 mols per mol of the magenta coupler.

22. The silver halide color photographic material of claim 3, wherein the amount of the synergistic light fastness improving agent of General Formula (V) is about 0.01 mols to about 20 mols per mol of the light fastness improving phenolic agent.

23. The method of claim 1, wherein said light fastness improving phenolic compound is one in which at least one of the ortho positions to the hydroxy group thereof is substituted with a tertiary alkyl group, having 4 to 24 carbon atoms, a bisphenol derivative, of the formula

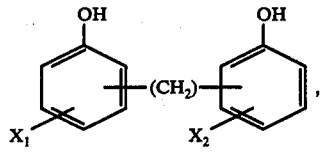

wherein $X_1$ and $X_2$ each represent a hydrogen atom, an alkyl group having 1 to 20 carbon atoms, an aryl group having 6 to 12 carbon atoms and comprises a single or condensed ring or an alkoxy group having 1 to 20 carbon atoms, a phosphoric acid ester of a phenol derivative wherein the phenol derivative is a phenol which can be substituted with an alkyl group having 1 to 20 carbon atoms, an alkoxy group having 1 to 20 carbon atoms or an aryl group having 6 to 12 carbon atoms which comprises a single or condensed ring, or a halophenol, and compounds represented by general formulae (III) or (IV):

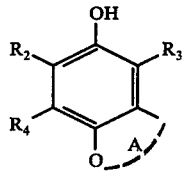

(III)

wherein $R_2$, $R_3$ and $R_4$, which may be the same or different, each represents a hydrogen atom, an alkyl group having 1 to 20 carbon atoms, a cycloalkyl group having 5 to 7 carbon atoms, an alkoxy group having 1 to 20 carbon atoms, an aryl group having 6 to 12 carbon atoms and comprising a single or condensed ring, an aryloxy group having 6 to 12 carbon atoms and comprising a single or condensed ring, an aralkyl group having 7 to 12 carbon atoms and comprising a single or condensed ring, an aralkoxy group having 7 to 12 carbon atoms and comprising a single or condensed ring, an alkenyl group having 1 to 20 carbon atoms, an alkenoxy group having 1 to 20 carbon atoms, an acylamino group having 2 to 20 carbon atoms, a halogen atom, an alkylthio group having 1 to 20 carbon atoms, an imido group having 3 to 20 carbon atoms, an acyl group having 2 to 20 carbon atoms, a sulfonamido group, an alkylamino group having 1 to 20 carbon atoms, an alkoxycarbonyl group, wherein the alkoxy moiety has 1 to 20 carbon atoms, or an acyloxy group, having 2 to 20 carbon atoms; and A represents a nonmetallic atom from carbon, oxygen, sulfur and nitrogen necessary to form a 5- or 6-membered ring containing a —C=C—O— moiety, which ring can be subbstituted with an alkyl group having 1 to 20 carbon atoms, an alkoxy group having 1 to 20 carbon atoms, an aryl group having 6 to 12 carbon atoms and comprising a single or condensed ring, an aryloxy group having 6 to 12 carbon atoms and comprising a single or condensed ring, an aralkyl group having 7 to 12 carbon atoms and comprising a single or condensed ring, an aralkoxy group having 7 to 12 carbon atoms and comprising a single or condensed ring, an alkenyl group having 1 to 20 carbon atoms, an alkenoxy group having 1 to 20 carbon atoms, an N-substituted amino group wherein the substituent is an alkyl group having 1 to 20 carbon atoms, an aryl group having 6 to 12 carbon atoms, an alkylene group having 4 to 6 carbon atoms, an oxydialkyl group having 3 to 5 carbon atoms, an iminodialkyl group having 3 to 5 carbon atoms or a thiodialkyl group having 3 to 5 carbon atoms, a 5- or 6-membered heterocyclic group or a condensed heterocyclic group containing a nitrogen, oxygen or sulfur atom as a hetero atom;

(IV)

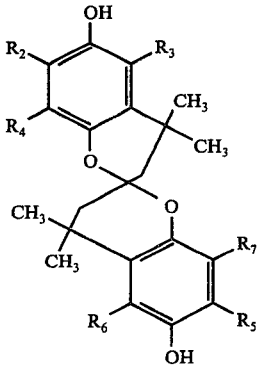

wherein $R_2$, $R_3$, $R_4$, $R_5$, $R_6$ and $R_7$, which can be the same or different, each has the same meaning as defined for $R_2$ in General Formula (III).

24. The method of claim 2, wherein said light fastness improving phenolic compound is one in which at least one of the ortho positions to the hydroxy group thereof is substituted with a tertiary alkyl group, having 4 to 24 carbon atoms, a bisphenol derivative, of the formula

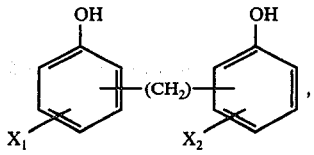

wherein $X_1$ and $X_2$ each represent a hydrogen atom, an alkyl group having 1 to 20 carbon atoms, an aryl group having 6 to 12 carbon atoms and comprises a single or condensed ring or an alkoxy group having 1 to 20 carbon atoms, a phosphoric acid ester of a phenol derivative wherein the phenol derivative is a phenol which can be substituted with an alkyl group having 1 to 20 carbon atoms, an alkoxy group having 1 to 20 carbon atoms or an aryl group having 6 to 12 carbon atoms which comprises a single or condensed ring, or a halophenol, and compounds represented by general formulae (III) or (IV):

(III)

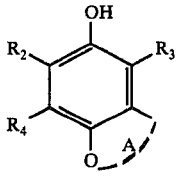

wherein $R_2$, $R_3$ and $R_4$, which may be the same or different, each represents a hydrogen atom, an alkyl group having 1 to 20 carbon atoms, a cycloalkyl group having 5 to 7 carbon atoms, an alkoxy group having 1 to 20 carbon atoms, an aryl group having 6 to 12 carbon atoms and comprising a single or condensed ring, an aryloxy group having 6 to 12 carbon atoms and comprising a single or condensed ring, an aralkyl group having 7 to 12 carbon atoms and comprising a single or condensed ring, an aralkoxy group having 7 to 12 carbon atoms and comprising a single or condensed ring, an alkenyl group having 1 to 20 carbon atoms, an alkenoxy group having 1 to 20 carbon atoms, an acylamino group having 2 to 20 carbon atoms, a halogen atom, an alkylthio group having 1 to 20 carbon atoms, an imido group having 3 to 20 carbon atoms, an acyl group having 2 to 20 carbon atoms, a sulfonamido group, an alkylamino group having 1 to 20 carbon atoms, an alkoxycarbonyl group, wherein the alkoxy moiety has 1 to 20 carbon atoms, or an acyloxy group, having 2 to 20 carbon atoms; and A represents a nonmetallic atom from carbon, oxygen, sulfur and nitrogen necessary to form a 5- or 6-membered ring containing a —C=C—O— moiety, which ring can be subbstituted with an alkyl group having 1 to 20 carbon atoms, an alkoxy group having 1 to 20 carbon atoms, an aryl group having 6 to 12 carbon atoms and comprising a single or condensed ring, an aryloxy group having 6 to 12 carbon atoms and comprising a single or condensed ring, an aralkyl group having 7 to 12 carbon atoms and comprising a single or condensed ring, an aralkoxy group having 7 to 12 carbon atoms and comprising a single or condensed ring, an alkenyl group having 1 to 20 carbon atoms, an alkenoxy group having 1 to 20 carbon atoms, an N-substituted amino group wherein the substituent is an alkyl group having 1 to 20 carbon atoms, an aryl group having 6 to 12 carbon atoms, an alkylene group having 4 to 6 carbon atoms, an oxydialkyl group having 3 to 5 carbon atoms, an iminodialkyl group having 3 to 5 carbon atoms or a thiodialkyl group having 3 to 5 carbon atoms, a 5- or 6-membered heterocyclic group or a condensed heterocyclic group containing a nitrogen, oxygen or sulfur atom as a hetero atom;
(IV)
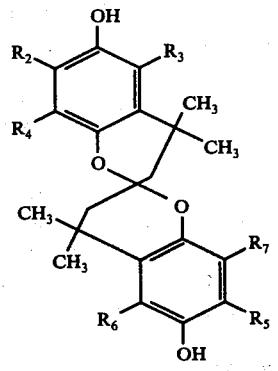
wherein $R_2$, $R_3$, $R_4$, $R_5$, $R_6$ and $R_7$, which can be the same or different, each has the same meaning as defined for $R_2$ in General Formula (III).
* * * * *